US008199931B1

(12) United States Patent
Norris et al.

(10) Patent No.: US 8,199,931 B1
(45) **Date of Patent: *Jun. 12, 2012**

(54) PARAMETRIC LOUDSPEAKER WITH IMPROVED PHASE CHARACTERISTICS

(75) Inventors: Elwood G. Norris, Poway, CA (US); Joseph O. Norris, Kapolei, HI (US); James J. Croft, III, San Diego, CA (US)

(73) Assignee: American Technology Corporation, San Diego, CA (US)

( * ) Notice: Subject to any disclaimer, the term of this patent is extended or adjusted under 35 U.S.C. 154(b) by 1087 days.

This patent is subject to a terminal disclaimer.

(21) Appl. No.: 12/106,909

(22) Filed: Apr. 21, 2008

Related U.S. Application Data

(60) Continuation of application No. 11/899,410, filed on Sep. 4, 2007, now abandoned, which is a continuation-in-part of application No. 10/984,343, filed on Nov. 8, 2004, now abandoned, which is a division of application No. 09/430,801, filed on Oct. 29, 1999, now Pat. No. 6,850,623, said application No. 11/899,410 is a continuation-in-part of application No. 11/065,698, filed on Feb. 24, 2005, now abandoned.

(51) Int. Cl.
*H04R 1/40* (2006.01)

(52) U.S. Cl. ..... 381/97; 381/89; 381/77; 381/111; 181/142

(58) Field of Classification Search ..... 381/15, 381/77, 79, 80, 82, 150, 111, 387, 152, 97, 381/191, 89; 367/137, 92; 181/142
See application file for complete search history.

(56) References Cited

U.S. PATENT DOCUMENTS

| | | | |
|---|---|---|---|
| 1,643,791 | A | 4/1924 | Slepian |
| 1,616,639 | A | 2/1927 | Sprague |
| 1,764,008 | A | 6/1930 | Crozier |
| 1,799,053 | A | 3/1931 | Mache |
| 1,809,754 | A | 6/1931 | Steedle |

(Continued)

FOREIGN PATENT DOCUMENTS

| | | |
|---|---|---|
| EP | 0 599 250 | 6/1994 |

(Continued)

OTHER PUBLICATIONS

Ultrasonic Ranging System by Polaroid Corporation.

(Continued)

*Primary Examiner* — Devona Faulk
*Assistant Examiner* — Disler Paul
(74) *Attorney, Agent, or Firm* — Thorpe North & Western LLP

(57) ABSTRACT

A method is disclosed for increasing a parametric output of a parametric loudspeaker system. The method can include the operation of providing multiple ultrasonic frequency emission zones that output signals in a frequency band. The phase relationships of the ultrasonic frequency emission zones can be correlated and controlled to increase phase coherence between each ultrasonic frequency emission zone to maximize parametric output. Correlating and controlling the phase relationships can include offsetting a frequency of a carrier signal applied to each emission zone from a resonant frequency of each emission zone in view of a rate of change of phase of each emission zone in a vicinity of each resonant frequency. Ultrasonic energy from the ultrasonic frequency emission zones can be generated, using the correlated phase relationship to increase the parametric output.

49 Claims, 14 Drawing Sheets

U.S. PATENT DOCUMENTS

| | | | |
|---|---|---|---|
| 1,951,669 | A | 3/1934 | Ramsey |
| 1,983,377 | A | 12/1934 | Kellogg |
| 2,461,344 | A | 2/1949 | Olson |
| 2,855,467 | A | 10/1958 | Curry |
| 2,872,532 | A | 2/1959 | Buchmann et al. |
| 2,935,575 | A | 5/1960 | Bobb |
| 2,975,243 | A | 3/1961 | Katella |
| 2,975,307 | A | 3/1961 | Schroeder et al. |
| 3,008,013 | A | 11/1961 | Williamson et al. |
| 3,012,107 | A | 12/1961 | Hanlet |
| 3,012,222 | A | 12/1961 | Hagemann |
| 3,136,867 | A | 6/1964 | Brettell |
| 3,345,469 | A | 10/1967 | Rod |
| 3,373,251 | A | 3/1968 | Seeler |
| 3,389,226 | A | 6/1968 | Peabody |
| 3,398,810 | A | 8/1968 | Clark, III |
| 3,461,421 | A | 8/1969 | Stover |
| 3,544,733 | A | 12/1970 | Reylek |
| 3,612,211 | A | 10/1971 | Clark, III |
| 3,613,069 | A | 10/1971 | Cary, Jr. |
| 3,641,421 | A | 2/1972 | Graf et al. |
| 3,654,403 | A | 4/1972 | Bobb |
| 3,674,946 | A | 7/1972 | Winey |
| 3,710,332 | A | 1/1973 | Tischner et al. |
| 3,723,957 | A | 3/1973 | Damon |
| 3,742,433 | A | 6/1973 | Kay et al. |
| 3,787,642 | A | 1/1974 | Young, Jr. |
| 3,821,490 | A | 6/1974 | Bobb |
| 2,825,834 | A | 7/1974 | Stuart et al. |
| 3,825,834 | A | 7/1974 | Stuart et al. |
| 3,829,623 | A | 8/1974 | Willis et al. |
| 3,833,771 | A | 9/1974 | Collinson |
| 3,836,951 | A | 9/1974 | Geren et al. |
| 3,892,927 | A | 7/1975 | Lindenberg |
| 3,908,098 | A | 9/1975 | Kawakami et al. |
| 3,919,499 | A | 11/1975 | Winey |
| 3,941,946 | A | 3/1976 | Kawakami et al. |
| 3,961,291 | A | 6/1976 | Whitehouse |
| 3,997,739 | A | 12/1976 | Kishikawa et al. |
| 4,005,278 | A | 1/1977 | Gorike |
| 4,015,089 | A | 3/1977 | Ishii et al. |
| 4,056,742 | A | 11/1977 | Tibbetts |
| 4,064,375 | A | 12/1977 | Russell et al. |
| 4,149,031 | A | 4/1979 | Cooper |
| 4,160,882 | A | 7/1979 | Driver |
| 4,166,197 | A | 8/1979 | Moog et al. |
| 4,207,571 | A | 6/1980 | Passey |
| 4,210,786 | A | 7/1980 | Winey |
| 4,242,541 | A | 12/1980 | Ando |
| 4,245,136 | A | 1/1981 | Krauel, Jr. |
| 4,256,922 | A | 3/1981 | Goerike |
| 4,265,122 | A | 5/1981 | Cook et al. |
| 4,284,921 | A | 8/1981 | Lemonon et al. |
| 4,289,936 | A | 9/1981 | Civitello |
| 4,295,214 | A | 10/1981 | Thompson |
| 4,322,877 | A | 4/1982 | Taylor |
| 4,378,596 | A | 3/1983 | Clark |
| 4,385,210 | A | 5/1983 | Marquiss |
| 4,418,248 | A | 11/1983 | Mathis |
| 4,418,404 | A | 11/1983 | Gordon et al. |
| 4,419,545 | A | 12/1983 | Kuindersma |
| 4,429,193 | A | 1/1984 | Busch-Vishniac et al. |
| 4,429,194 | A | 1/1984 | Kamon et al. |
| 4,432,079 | A | 2/1984 | Mackelburg et al. |
| 4,433,750 | A | 2/1984 | Neese |
| 4,434,327 | A | 2/1984 | Busch-Vishniac et al. |
| 4,439,642 | A | 3/1984 | Reynard |
| 4,471,172 | A | 9/1984 | Winey |
| 4,480,155 | A | 10/1984 | Winey |
| 4,503,553 | A | 3/1985 | Davis |
| 4,550,228 | A | 10/1985 | Walker et al. |
| 4,558,184 | A | 12/1985 | Busch-Vishniac et al. |
| 4,593,160 | A | 6/1986 | Nakamura |
| 4,593,567 | A | 6/1986 | Isselstein et al. |
| 4,600,891 | A | 7/1986 | Taylor, Jr. et al. |
| 4,672,591 | A | 6/1987 | Breimesser et al. |
| 4,695,986 | A | 9/1987 | Hossack |
| 4,703,462 | A | 10/1987 | Woodsum |
| 4,751,419 | A | 6/1988 | Takahata |
| 4,784,915 | A | 11/1988 | Sakagami et al. |
| 4,803,733 | A | 2/1989 | Carver et al. |
| 4,809,355 | A | 2/1989 | Drefahl |
| 4,823,908 | A | 4/1989 | Tanaka et al. |
| 4,837,838 | A | 6/1989 | Thigpen et al. |
| 4,885,781 | A | 12/1989 | Seidel |
| 4,887,246 | A | 12/1989 | Hossack et al. |
| 4,888,086 | A | 12/1989 | Hossack et al. |
| 4,903,703 | A | 2/1990 | Igarashi et al. |
| 4,908,805 | A | 3/1990 | Sprenkels et al. |
| 4,939,784 | A | 7/1990 | Bruney |
| 4,991,148 | A | 2/1991 | Gilchrist |
| 4,991,687 | A | 2/1991 | Oyaba et al. |
| 5,054,081 | A | 10/1991 | West |
| 5,079,751 | A | 1/1992 | Woodward |
| 5,095,509 | A | 3/1992 | Volk |
| 5,109,416 | A | 4/1992 | Croft |
| 5,115,672 | A | 5/1992 | McShane et al. |
| 5,142,511 | A | 8/1992 | Kanai et al. |
| 5,153,859 | A | 10/1992 | Chatigny et al. |
| 5,181,301 | A | 1/1993 | Wheeler |
| 5,276,669 | A | 1/1994 | Oohashi et al. |
| 5,287,331 | A | 2/1994 | Schindel et al. |
| 5,317,543 | A | 5/1994 | Grosch |
| 5,357,578 | A | 10/1994 | Taniishi |
| 5,392,358 | A | 2/1995 | Driver |
| 5,406,634 | A | 4/1995 | Anderson et al. |
| 5,430,805 | A | 7/1995 | Stevenson et al. |
| 5,487,114 | A | 1/1996 | Dinh |
| 5,539,705 | A | 7/1996 | Akerman et al. |
| 5,572,201 | A | 11/1996 | Graham et al. |
| 5,582,176 | A | 12/1996 | Swerling et al. |
| 5,619,383 | A | 4/1997 | Ngai |
| 5,638,456 | A | 6/1997 | Conley et al. |
| 5,649,019 | A | 7/1997 | Thomasson |
| 5,662,190 | A | 9/1997 | Abe |
| 5,666,327 | A | 9/1997 | Medeiros et al. |
| 5,700,359 | A | 12/1997 | Bauer |
| 5,745,582 | A | 4/1998 | Shimpuku et al. |
| 5,748,758 | A | 5/1998 | Menasco, Jr. et al. |
| 5,758,177 | A | 5/1998 | Gulick et al. |
| 5,767,609 | A | 6/1998 | Suganuma |
| 5,809,400 | A | 9/1998 | Abramsky et al. |
| 5,832,438 | A | 11/1998 | Bauer |
| 5,844,998 | A | 12/1998 | Nageno |
| 5,859,915 | A | 1/1999 | Norris |
| 5,885,129 | A | 3/1999 | Norris |
| 5,889,870 | A * | 3/1999 | Norris ..... 381/77 |
| 5,892,315 | A | 4/1999 | Gipson et al. |
| 5,919,134 | A | 7/1999 | Diab |
| 5,982,805 | A | 11/1999 | Kaneda |
| 6,011,855 | A | 1/2000 | Selfridge et al. |
| 6,044,160 | A | 3/2000 | Norris |
| 6,052,336 | A | 4/2000 | Lowrey, III |
| 6,064,259 | A | 5/2000 | Takita |
| 6,104,825 | A | 8/2000 | Thigpen |
| 6,108,427 | A | 8/2000 | Norris et al. |
| 6,108,433 | A | 8/2000 | Norris |
| 6,151,398 | A | 11/2000 | Norris |
| 6,188,772 | B1 | 2/2001 | Norris et al. |
| 6,205,104 | B1 | 3/2001 | Nagashima et al. |
| 6,229,899 | B1 | 5/2001 | Norris et al. |
| 6,232,833 | B1 | 5/2001 | Pullen |
| 6,304,662 | B1 | 10/2001 | Norris et al. |
| 6,356,872 | B1 | 3/2002 | Leung et al. |
| 6,359,990 | B1 | 3/2002 | Norris |
| 6,378,010 | B1 | 4/2002 | Burks |
| 6,445,804 | B1 | 9/2002 | Hirayanagi |
| 6,556,687 | B1 | 4/2003 | Manabe |
| 6,577,738 | B2 | 6/2003 | Norris et al. |
| 6,584,205 | B1 | 6/2003 | Croft, III et al. |
| 6,606,389 | B1 * | 8/2003 | Selfridge et al. ..... 381/111 |
| 6,666,374 | B1 | 12/2003 | Green et al. |
| 6,678,381 | B1 | 1/2004 | Manabe |
| 6,768,376 | B2 | 7/2004 | Hoyt et al. |
| 6,771,785 | B2 | 8/2004 | Pompei |
| 6,850,623 | B1 | 2/2005 | Norris et al. |
| 6,859,096 | B2 | 2/2005 | Tanaka et al. |

| | | | | |
|---|---|---|---|---|
| 7,162,042 | B2 | 1/2007 | Spencer et al. | |
| 7,801,315 | B2 * | 9/2010 | Watanabe et al. | 381/77 |
| 2001/0007591 | A1 | 7/2001 | Pompei | |
| 2002/0101360 | A1 | 8/2002 | Schrage | |
| 2002/0191808 | A1 | 12/2002 | Croft, III et al. | |
| 2004/0247140 | A1 * | 12/2004 | Norris et al. | 381/77 |
| 2005/0207587 | A1 | 9/2005 | Pompei | |

FOREIGN PATENT DOCUMENTS

| | | |
|---|---|---|
| EP | 0 973 152 | 1/2000 |
| JP | 360021695 A | 2/1985 |
| JP | 2265397 | 10/1990 |
| JP | H2-265400 | 10/1990 |
| WO | WO 98/02978 | 1/1998 |
| WO | WO 98/49868 | 4/1998 |
| WO | WO 99/35881 | 7/1999 |
| WO | WO 99/35884 | 7/1999 |
| WO | WO 01/08449 | 2/2001 |
| WO | WO 01/33902 | 5/2001 |
| WO | WO 01/52437 | 7/2001 |

OTHER PUBLICATIONS

Excerpts From on Combination Tones by Helmholtz, Editor's Comments on Paper 16, pp. 228-238.

Aoki, Kenichi et al. Parametric Loudspeaker—Characteristics of Acoustic Field and Suitable Modulation of Carrier Ultrasound, Electronics and Communications in Japan, Part 3, vol. 74, No. 9, pp. 76-82 (1991).

Makarov et al, "Parametric Acoustic Nondirectional Radiator", Acustica, vol. 77, pp. 240-242 (1992).

Yoneyama, et al, "The Audio Spotlight: An Application of Nonlinear Interaction of Sound Waves to a New Type of Loudspeaker Design", J. Acoustical Society of America 73(5), May 1983, pp. 1532-1536.

Crandall, I.B. The Air-Damped Vibrating System: Theoretical Calibration of the Condenser Transmitter, American Physical Society, Dec. 28, 1917, pp. 449-460.

Peter J. W., "Parametric Acoustic Array", The Journal of the Acoustical Society of America, vol. 35, No. 1, Apr. 1963, pp. 535-537.

Wagner, Ronald, Electrostatic Loudspeaker Design and Construction, Chapters 4 and 5, pp. 59-91, Audio Amateur Press Publishers, 1993.

Berktay, H.O., "Possible Exploitation of Non-Linear Acoustics in Underwater Transmitting Applications", Department of Electronic and Electrical Engineering University of Birmingham, Edgbaston, Birmingham 15, England (Received Apr. 13, 1965).

Berktay, H.O. et al. "Arrays of Parametric Receiving Arrays," The Journal of the Acoustical Society of America, pp. 1377-1383.

Piwnicki, Konrad, "Modulation Methods Related to Sine-Wave Crossings" IEEE Transactions on Communications, 1983, pp. 503-508, vol. COM-31, No. 4.

Marvasti, Farokh, "Modulation Methods Related to Sine Wave Crossings" IEEE Transactions on Communications, 1985, pp. 177-178, vol. COM-33, No. 2.

Pompei; The Use of Airborne Ultrasonics for Generating Audible Sound Beams; Presented at the 105th Convention Sep. 26-29, 1998.

Moffett et al. "Model for parametric acoustic sources." J. Acoust. Soc. Am., Feb. 1977, pp. 325-337, vol. 61. No. 2.

Kamakura, et al.; Suitable Modulation of the Carrier Ultrasound for Parametric Loudspeaker; Acustica vol. 73 (1991).

Berktay, et al.; Nearfield effects in end-fire line arrays; The Journal of the Acoustical Society of America; 1973; pp. 550-556.

Kamakura et al. "Developments of Parametric Loundspeaker for Practical Use." 10th International Symposium on Nonlinear Acoustics, 1984, pp. 147-150.

Muir, et al.; Parametric Acoustic Transmitting Arrays; The Journal of the Acousticval Society of America; 1972; pp. 1481-1485.

Kite et al. "Parametric Array in Air: Distortion Reduction by Preprocessing," Applied Research Laboratories, University of Texas, 2 pages.

Kite et al. "Parametric Array in Air: Distortion Reduction by Preprocessing," Applied Research Laboratories, University of Texas, 11 pages.

Willette et al. "Harmonics of the difference frequency in saturation-limited parametric sources." J. Acoust. Soc. Am., Dec. 1977, pp. 1377-1381, vol. 62, No. 6.

Havelock, et al., Directional Loudspeakers Using Sound Beams; J. Audio Eng. Soc., vol. 48, No. 10, Oct. 2000; pp. 908-916.

Kamakura, et al., A Study for the Realization of a Parametric Loudspeaker, 1985; pp. 1-18.

Norris, U.S. Appl. No. 11/065,698, filed Feb. 24, 2005.

* cited by examiner

| Number of Transducers | Transducer Type | Ultrasonic dB | Parametric dB |
|---|---|---|---|
| 1 | single | 120 dB | 50 dB |
| 100 | unphased | 134 dB | 78 dB |
| 100 | phased | 139 dB | 88 dB |
| 100 | ideal | 140 dB | 90 dB |

FIG. 5

PARAMETRIC LOUDSPEAKER WITH IMPROVED PHASE CHARACTERISTICS

CROSS-REFERENCE TO RELATED APPLICATIONS AND CLAIM OF PRIORITY

This is a continuation of U.S. patent application Ser. No. 11/899,410, filed Sep. 4, 2007 now abandoned; which is a continuation-in-part of U.S. patent application Ser. No. 10/984,343 filed on Nov. 8, 2004 now abandoned; which is a divisional of U.S. patent application Ser. No. 09/430,801 filed Oct. 29, 1999, now U.S. Pat. No. 6,850,623, issued Feb. 1, 2005; and is a continuation-in-part of U.S. patent application Ser. No. 11/065,698, filed Feb. 24, 2005 now abandoned, all of which are hereby incorporated herein by reference in their entirety.

BACKGROUND

1. Field of the Invention

This invention relates generally to the field of parametric loudspeakers.

2. Related Art

Audio reproduction has long been considered a well-developed technology. Over the decades, sound reproduction devices have moved from a mechanical needle on a cylinder or vinyl disk, to analog and digital reproduction using lasers and many other forms of electronic media. Advanced computers and software now allow complex programming of signal processing and manipulation of synthesized sounds to create new dimensions of listening experience, including applications within movie and home theater systems. Computer generated audio is reaching new heights by creating sounds that are no longer limited to reality, but extend into the creative realms of imagination.

Nevertheless, the actual reproduction of sound at the interface of electro-mechanical speakers with the air has remained substantially the same in principle for almost one hundred years. Such speaker technology is clearly dominated by dynamic speakers, which constitute more than 90 percent of commercial speakers in use today. Indeed, the general class of audio reproduction devices referred to as dynamic speakers began with the simple combination of a magnet, voice coil, and cone, driven by an electronic signal. The magnet and voice coil convert the variable voltage of the signal to mechanical displacement, representing a first stage within the dynamic speaker as a conventional multistage transducer. The attached cone provides a second stage of impedance matching between the electrical transducer and air envelope surrounding the transducer, enabling transmission of small vibrations of the voice coil to emerge as expansive compression waves that can fill an auditorium. Such multistage systems comprise the current fundamental approach to reproduction of sound, particularly at high energy levels.

A lesser category of speakers, referred to generally as film or diaphragmatic transducers, relies on movement of an emitter surface area of film that is typically generated by electrostatic or planar magnetic driver members. Although electrostatic speakers have been an integral part of the audio community for many decades, their popularity has been quite limited. Typically, such film emitters are known to be low-power output devices having limited applications. With a few exceptions, commercial film transducers have found primary acceptance as tweeters and other high frequency devices in which the width of the film emitter is equal to or less than the propagated wavelength of sound. Attempts to apply larger film devices have resulted in poor matching of resonant frequencies of the emitter with sound output, as well as a myriad of mechanical control problems such as maintenance of uniform spacing from the stator or driver, uniform application of electromotive fields, phase matching, frequency equalization, etc.

As with many well-developed technologies, advances in the state of the art of sound reproduction have generally been limited to minor enhancements and improvements within the basic fields of dynamic and electrostatic systems. Indeed, substantially all of these improvements operate within the same fundamental principles that have formed the basics of well-known audio reproduction. These include the concepts that (i) sound is generated at a speaker face, (ii) based on reciprocating movement of a transducer (iii) at frequencies that directly stimulate the air into the desired audio vibrations. From this basic concept stems the myriad of speaker solutions addressing innumerable problems relating to the challenge of optimizing the transfer of energy from a dense speaker mass to the almost mass-less air medium that propagates the sound.

A second fundamental principle common to prior art dynamic and electrostatic transducers is the fact that sound reproduction is based on a linear mode of operation. In other words, the physics of conventional sound generation relies on mathematics that conform to linear relationships between absorbed energy and the resulting wave propagation in the air medium. Such characteristics enable predictable processing of the audio signals, with an expectation that a given energy input applied to a circuit or signal will yield a corresponding, proportional output when propagated as a sound wave from the transducer.

In such conventional systems, maintaining the air medium in a linear mode is extremely important. If the air is driven excessively into a nonlinear state, severe distortion occurs and the audio system is essentially unacceptable. This nonlinearity occurs when the air molecules adjacent the dynamic speaker cone or emitter diaphragm surface are driven to excessive energy levels that exceed the ability of the air molecules to respond in a corresponding manner to speaker movement. In simple terms, when the air molecules are unable to match the movement of the speaker so that the speaker is loading the air with more energy than the air can dissipate in a linear mode, then a nonlinear response occurs and leads to severe distortion and speaker inoperability. Conventional sound systems are therefore built to avoid this limitation, ensuring that the speaker transducer operates strictly within a linear range.

Parametric sound systems, however, represent an anomaly in audio sound generation. Instead of operating within the conventional linear mode, parametric sound can only be generated when the air medium is driven into a nonlinear state. Within this unique realm of operation, audio sound is not propagated from the speaker or transducer element. Instead, the transducer is used to propagate carrier waves of high-energy, ultrasonic bandwidth beyond human hearing. The ultrasonic wave functions as the carrier wave, which can be modulated with audio input that develops sideband characteristics capable of decoupling in air when driven to the nonlinear condition. In this manner, it is the air molecules and not the speaker transducer that will generate the audio component of a parametric system. Specifically, it is the sideband components of the ultrasonic carrier wave that energizes the air molecule with audio signals, enabling wave propagation at audio frequencies.

Another fundamental distinction of a parametric speaker system from that of conventional audio is that high-energy transducers as characterized in prior art audio systems do not appear to provide the necessary energy for effective parametric speaker operation. For example, the dominant dynamic speaker category of conventional audio systems is well known for its high-energy output. The capability of a cone/magnet transducer to transfer high-energy levels to surrounding air is evident from the fact that virtually all high-power audio speaker systems currently in use rely on dynamic speaker devices. In contrast, low output devices such as electrostatic and other diaphragm transducers are virtually unacceptable for high-power requirements. As an example, consider the outdoor audio systems that service large concerts at stadiums and other outdoor venues. Normally, massive dynamic speakers are necessary to develop direct audio to such audiences. To suggest that a low-power film diaphragm might be applied in this setting would be considered foolish and impractical.

Whereas conventional audio systems rely on well accepted acoustic principles of (i) generating audio waves at the face of the speaker transducer, (ii) based on a high-energy output device such as a dynamic speaker, (iii) while operating in a linear mode, the present inventors have discovered that just the opposite design criteria are preferred for parametric applications. Specifically, effective parametric sound is effectively generated using (i) a comparatively low-energy emitter, (ii) in a nonlinear mode, (iii) to propagate an ultrasonic carrier wave with a modulated sideband component that is decoupled in air (iv) at extended distances from the face of the transducer. In view of these distinctions, it is not surprising that much of the conventional wisdom developed over decades of research in conventional audio technology is simply inapplicable to problems associated with the generation parametric sound.

Historically parametric speakers have not been able to achieve high performance for multiple reasons, much of which can be attributed to transducer performance. In the prior art, devices are disclosed that use piezoelectric bimorph devices which are also known as piezoelectric benders. The prior art systems have used clusters of piezoelectric bimorphs that number anywhere from 500 to over 1400 bimorph units. The large number of bimorphs is due to the very high ultrasonic outputs required for a parametric loudspeaker. The output performance from these bimorph devices has not been adequate in prior art systems.

An example of the prior art is described in the article, "The audio spotlight: An application of nonlinear interaction of sound waves to a new type of loudspeaker design.", by Yoneyama and Fujimoto in the *Journal of the Acoustical Society of America*, Volume 73, 1983, which is incorporated herein by reference. Their use of an array of 547 piezo bimorph type transducers typifies previous and subsequent prior art parametric loudspeakers.

As with other prior art parametric loudspeakers, Yoneyama teaches placing the primary carrier frequency or carrier signal at the transducer's resonant frequency which is the frequency of maximum amplitude for a single transducer. This is the region of highest amplitude and has been presumed to provide the best performance for an array of transducers. Further, Yoneyama teaches the mounting of the multiple transducers all in the same plane. However, it is believed that such prior art arrays all suffer from the disproportionate loss of sound pressure level (SPL) with increasing numbers of transducers. Accordingly, a method for increasing the SPL in parametric loudspeakers and minimizing disproportionate loss is greatly desired.

SUMMARY

A method is disclosed for increasing a parametric output of a parametric loudspeaker system. The method can include the operation of providing multiple ultrasonic frequency emission zones that output signals in a frequency band. The phase relationships of the ultrasonic frequency emission zones can be correlated and controlled to increase phase coherence between each ultrasonic frequency emission zone to maximize parametric output. Correlating and controlling the phase relationships can include offsetting a frequency of a carrier signal applied to each emission zone from a resonant frequency of each emission zone in view of a rate of change of phase of each emission zone in a vicinity of each resonant frequency. Ultrasonic energy from the ultrasonic frequency emission zones can be generated using the correlated phase relationship to increase the parametric output.

BRIEF DESCRIPTION OF THE DRAWINGS

Additional features and advantages of the invention will be apparent from the detailed description which follows, taken in conjunction with the accompanying drawings, which together illustrate, by way of example, features of the invention; and, wherein:

FIG. 5 shows an example parametric output of the present invention versus the prior art;

Reference will now be made to the exemplary embodiments illustrated, and specific language will be used herein to describe the same. It will nevertheless be understood that no limitation of the scope of the invention is thereby intended.

DETAILED DESCRIPTION OF EXAMPLE EMBODIMENTS

Because parametric sound is a developing field, and in order to identify the distinctions between parametric sound and conventional audio systems, the following definitions, along with explanatory diagrams, are provided. While the following definitions may also be employed in future applications from the present inventor(s), the definitions are not meant to retroactively narrow or define past applications or patents from the present inventor(s), their associates, or assignees.

Figure 1A:
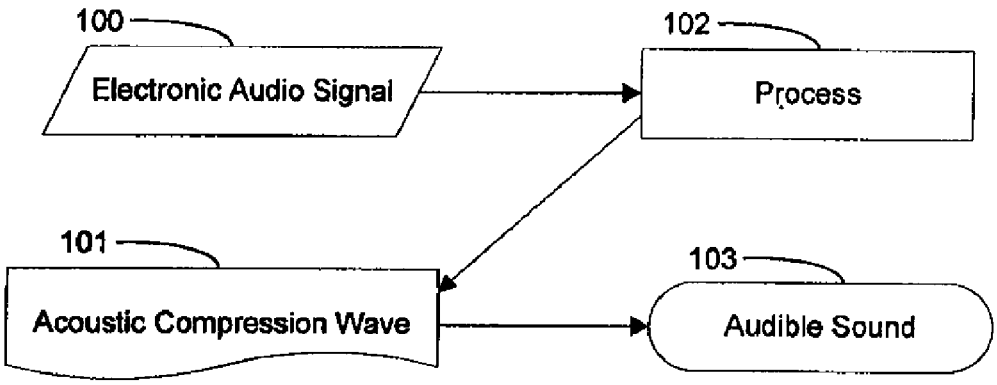
FIG. 1*a* is a reference diagram for parametric sound production.
Figure 1B:
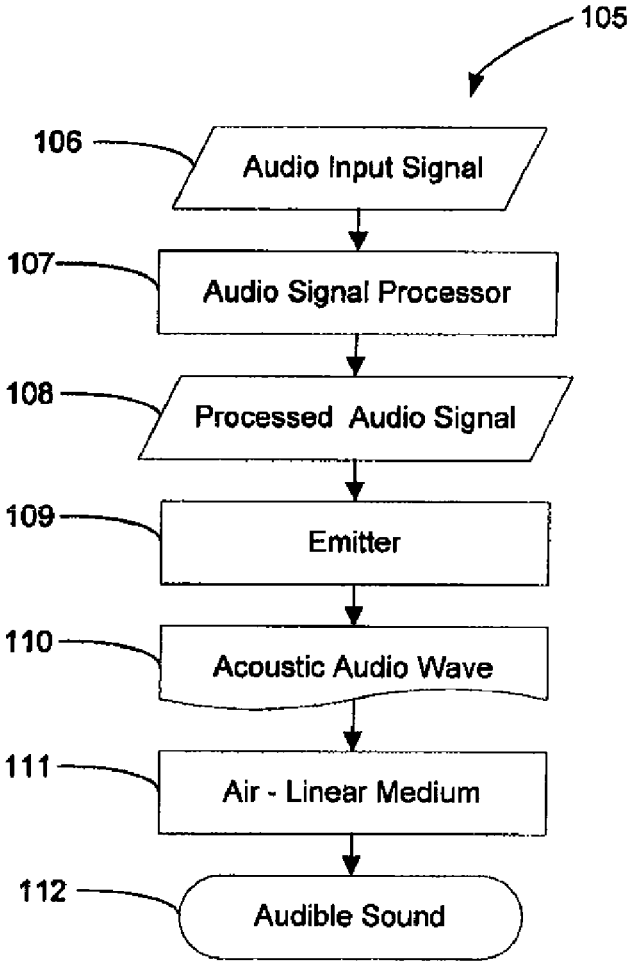
FIG. 1b (Prior Art)
FIG. 1*b* is a flow diagram of a conventional audio system.
Figure 1C:
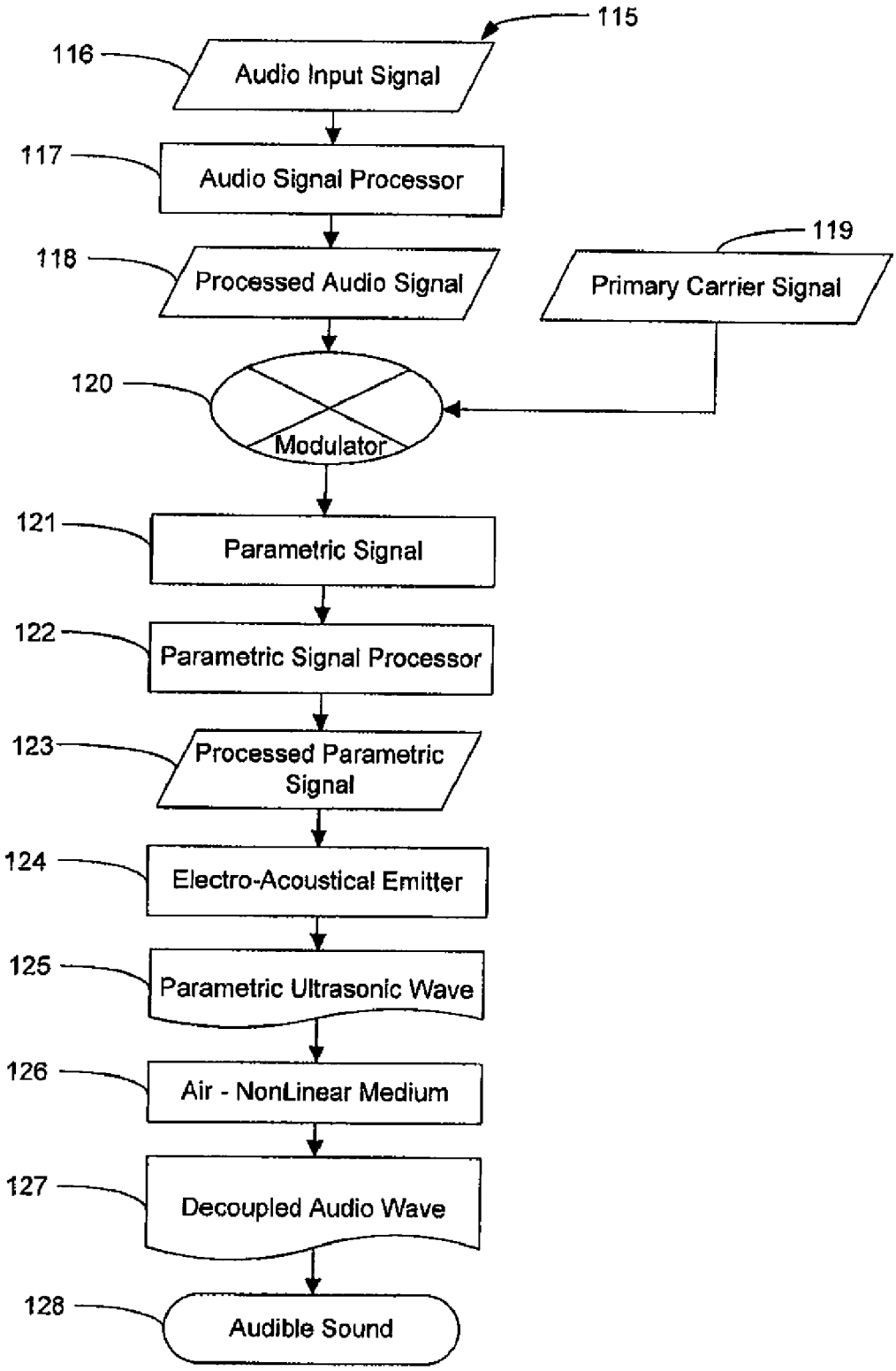
FIG. 1*c* is a flow diagram illustrating the complexities of a parametric audio system, and defining the terminology of a parametric audio system.

FIG. 1*a* serves the purpose of establishing the meanings that will be attached to various block diagram shapes in FIGS. 1*b* and 1*c*. The block labeled 100 can represent any electronic input audio signal. Block 100 will be used whether the audio signal corresponds to a subsonic signal, sonic signal, ultrasonic signal, or a parametric ultrasonic signal. Throughout this application, any time the word 'signal' is used, it refers to an electronic representation of an audio component, as opposed to an acoustic compression wave.

The block labeled 101 will represent any acoustic compression wave. An acoustic compression wave is propagated into the air, as opposed to an audio signal, which is in electronic form. The block 101 representing acoustic compression waves will be used whether the compression wave corresponds to a subsonic wave, sonic wave, ultrasonic wave, or a parametric wave comprised of two or more waves. Throughout this application, any time the word 'wave' is used, it refers to an acoustic compression wave which is propagated into a physical medium such as air.

The block labeled 102 will represent any process that changes or affects the audio signal or wave passing through the process. The audio passing through the process may either be an electronic audio signal or an acoustic compression wave. The process may either be an artificial process, such as a signal processor or an emitter, or a natural process such as a transition in an air medium.

The block labeled 103 will represent the actual audible sound that results from an acoustic compression wave. Examples of audible sound may be the sound heard in the ear of a user, or the sound sensed by a microphone. Audible sound is produced by acoustic waves produced within the typical range of human hearing, i.e. 30 Hz to 20,000 Hz.

FIG. 1*b* is a flow diagram 105 of a conventional audio system. In a conventional audio system, an audio input signal 106 is supplied which is an electronic representation of the audio wave to be reproduced. The audio input signal 106 may optionally pass through an audio signal processor 107. The audio signal processor is usually limited to linear processing, such as the amplification of certain frequencies and attenuation of others. The audio signal processor 107 may apply non-linear processing to the audio input signal 106 in order to adjust for non-linear distortion that may be directly introduced by the emitter 109. If the audio signal processor 107 is used, it produces a processed audio signal 108.

The processed audio signal 108 or the audio input signal 106 (if the audio signal processor 107 is not used) is then emitted from the emitter 109. As previously discussed, conventional sound systems typically employ dynamic speakers as their emitter source. Dynamic speakers are typically comprised of a simple combination of a magnet, voice coil and cone. The magnet and voice coil convert the variable voltage of the processed audio signal 108 to mechanical displacement, representing a first stage within the dynamic speaker as a conventional multistage transducer. The attached cone provides a second stage of impedance matching between the electrical transducer and air envelope surrounding the emitter 109, enabling transmission of small vibrations of the voice coil to emerge as expansive acoustic audio waves 110. The acoustic audio waves 110 proceed to travel through the air 111, with the air substantially serving as a linear medium. Finally, the acoustic audio wave reaches the ear of a listener, who hears audible sound 112.

FIG. 1*c* is a flow diagram 115 that clearly highlights the complexity of a parametric sound system as compared to the conventional audio system of FIG. 1*b*. The parametric sound system also begins with an audio input signal 116. The audio input signal 116 may optionally pass through an audio signal processor 117.

The processed audio signal 118 or the audio input signal 116 (if the audio signal processor 117 is not used) is then modulated with a primary carrier signal 119 using a modulator 120. The primary carrier signal 119 may be supplied by a primary signal source. The primary signal source for a parametric sound system is typically an ultrasonic signal source. However, it is also possible to use a sonic signal source.

While the primary carrier signal 119 is normally fixed at a constant frequency, it is possible to have a primary carrier signal that varies in frequency. The modulator 120 is configured to produce a parametric signal 121, which is comprised of a carrier signal, which is normally fixed at a constant frequency, and at least one sideband signal, wherein the sideband signal frequencies vary such that the difference between the sideband signal frequencies and the carrier signal frequency are the same frequency as the audio input signal 116. The modulator 120 may be configured to produce a parametric signal 121 that either contains one sideband signal (single sideband modulation, or SSB), or both upper and lower sidebands (double sideband modulation, or DSB). Alternatively, the modulator 120, or a filter used in conjunction with the modulator, can produce an output having a suppressed carrier signal, wherein the SSB or DSB signal is substantially the only output. The SSB or DSB signal output of the modulator can then be combined with the primary carrier signal 119 to produce a parametric signal.

The parametric signal 121 may optionally pass through a parametric signal processor 122. The parametric signal processor can be used to amplify or attenuate the sideband and/or primary carrier signals in the parametric signal. Additional signal processing may also occur to adjust for non-linear distortion which may occur at the electro-acoustical emitter 124, the nonlinear medium 126, or when the audio wave decouples 127. If the parametric signal processor is used, it produces a processed parametric signal 123.

The processed parametric signal 123 is then emitted from the electro-acoustical emitter 124, producing a parametric wave 125 which is propagated into the air or nonlinear medium 126. The parametric wave 125 is comprised of a carrier wave and at least one sideband wave. The parametric ultrasonic wave 125 can drive the air into a substantially non-linear state. Air is typically linear at lower amplitudes and frequencies. However, at higher amplitudes and higher frequencies, air molecules don't respond in synchronization with the device producing the waves (i.e. a speaker, transducer, or emitter) and non-linear effects can occur. The air can serve as a non-linear medium, wherein acoustic heterodyning can occur on the parametric wave 125, causing the ultrasonic carrier wave and the at least one sideband wave to decouple in air and produce a decoupled audio wave 127 whose frequency is the difference between the carrier wave frequency and the sideband wave frequencies. Finally, the decoupled audio wave 127 reaches the ear of a listener, who can hear audible sound 128. The end goal of parametric audio systems is for the decoupled audio wave 127 to closely correspond to the original audio input signal 116, such that the audible sound 128 is 'pure sound', or the exact representation of the audio input signal. However, because of the nature of parametric loudspeaker technology, including the difficulty of producing a decoupled audio wave 127 having significant intensity over a wide band of audio frequencies, attempts to produce 'pure sound' with parametric loudspeakers have been limited. The above process describing parametric audio systems is thus far substantially known in the prior art.

To produce the greatest output from a parametric loudspeaker, each ultrasonic emitter is typically designed to output a maximum power. The greatest output from a piezoelectric transducer can usually be obtained by operating the transducer at its resonant frequency. A resonant frequency is the frequency at which a device, such as an electro-acoustical emitter, will vibrate most efficiently. In the case of a piezoelectric device, it will produce the highest output with the least amount of voltage applied. As used herein, the resonant frequency of an electro-acoustical emitter is the frequency at which the emitter vibrates most efficiently. This is typically the emitter's fundamental resonant frequency. However, the resonant frequency may also be a harmonic of the fundamental resonant frequency.

Figure 1D:
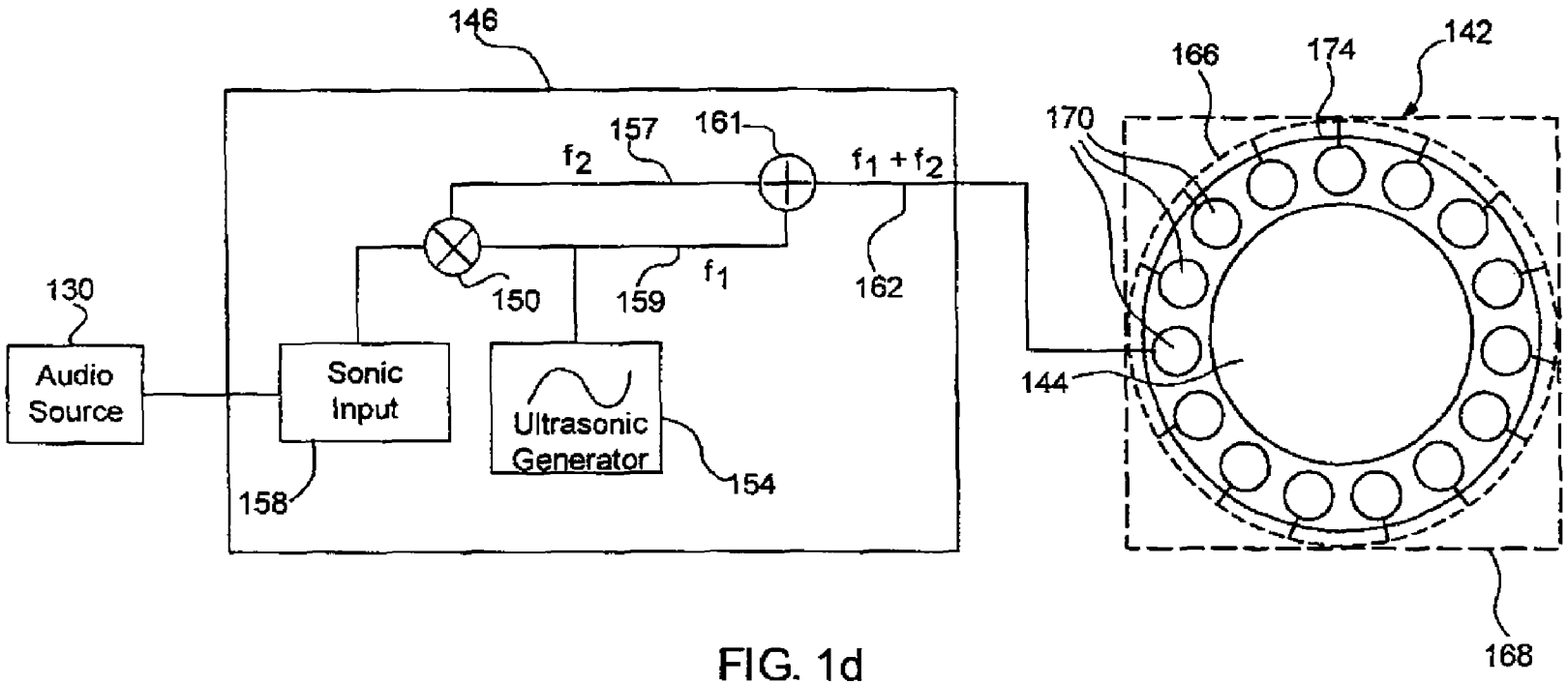
FIG. 1*d* illustrates a block diagram of a parametric loudspeaker and supporting circuitry in accordance with an embodiment of the present invention.

FIG. 1*d* illustrates a design of a simple parametric loudspeaker system. The parametric speaker 142 includes an example circuit 146 in which a modulator 150 is coupled to an ultrasonic frequency generator 154 and an audio input 158. The audio input can be received from an external audio source 130. The external audio source can include a digital audio source, an analog audio source, a pre-recorded audio source, or a live audio source such as a microphone. The ultrasonic frequency generator 154 can produce a primary carrier signal $f_1$ 159. The modulator 150 operates to produce a sideband signal $f_2$ 157 having a frequency difference from the primary carrier signal 159 such that the frequency of the modulated output, or sideband signal $f_2$ 157, comprises the sum or difference of the frequencies of the audio input signal 158 and the primary carrier signal $f_1$ 159. The primary carrier and sideband signals can be combined 161 to produce an ultrasonic parametric signal 162 such that the audio input signal 158 can be decoupled from the ultrasonic parametric signal 162 when the parametric signal is produced within a nonlinear medium such as air.

For example, the audio input signal 158 can be a 5 kHz audio signal. The ultrasonic frequency generator 154 can produce a 40 kHz primary carrier signal, $f_1$ 159. The audio signal and the primary carrier signal 159 can be modulated, or sent through a nonlinear circuit such as a single sideband mixer 150. The single sideband mixer 150 can be configured to output a sideband that is either a sum, 45 kHz, or a difference, 35 kHz, of the primary carrier and audio signals. In this example it will be assumed that the mixer will output the sum, 45 kHz. Signal processing can then be applied to the sideband output of the single sideband mixer, $f_2$ 161. The sideband $f_2$ 161 can then be combined 157 with the primary carrier signal 159 $f_1$ to create an ultrasonic parametric signal 162 comprising both the 45 kHz sideband signal output from the mixer and the 40 kHz primary carrier signal. The ultrasonic parametric signal 162 can then be emitted by the parametric speaker 142 into a nonlinear medium such as air. The ultrasonic parametric signal 162 can be emitted as a plurality of ultrasonic parametric waves at a power level sufficient to drive the medium into nonlinearity. The nonlinear medium of air can operate to create sum and difference frequencies for the waves comprising the ultrasonic parametric waves. In this example, the nonlinear medium of air can cause a sum signal of the 45 kHz sideband waves and the 40 kHz primary carrier waves to create a plurality of 85 kHz sum waves. Similarly, difference waves can be created at an audio frequency of 5 kHz. The 85 kHz sum waves are well beyond the human hearing range of 20 kHz and will not be perceived by a listener. Thus, the 5 kHz audio waves will be the only frequency perceived by the listener.

In the embodiment illustrated in FIG. 1*d*, the audio input 158 can vary in amplitude and frequency to enable the parametric loudspeaker 142 to emit an ultrasonic parametric signal 162 which can decouple in air to produce varying audio signals such as voice, music, or other sounds. The varying audio input 158 can be modulated 150 onto the primary carrier signal $f_1$ 159 to produce a sideband signal $f_2$ 161 in a modulated output. The modulated output can be filtered to provide a single sideband output comprising the sum or difference of the ultrasonic signal and the sonic input 158. The sideband signal $f_2$ 161 can vary in frequency at the same rate as the audio input 158. The primary carrier $f_1$ and sideband $f_2$ signals can then be combined 161 to create the ultrasonic parametric signal 162, which can be emitted by the parametric speaker 142. The primary carrier signal $f_1$ 159 can be substantially static, staying substantially the same at a predetermined set frequency. When the ultrasonic parametric signal 162 is emitted to the air at a sufficient power and frequency, the nonlinear effects of air can cause the sum and difference of $f_1$ and $f_2$ to be produced. Thus, as $f_2$ 157 varies, the difference between the two frequencies will vary. The varying difference can result in a substantial reproduction of the original varying audio input 158 within the medium of air.

FIG. 1*d* also identifies an ultrasonic emitter component 166 of the parametric loudspeaker 142. This component 166 comprises at least one electro-acoustical emitter 170 coupled to the modulator 150 that is aligned for transmission with a directional orientation of a housing (not shown) which is orthogonal to the center 144. Each emitter 170 may be a transducer or other means for generating an ultrasonic primary carrier signal in accordance with parametric technology.

The specific emitters 170 shown in this embodiment comprise a set of bimorph transducers which form a perimeter for the outside of the horn emitter end 174. The perimeter of FIG. 1*d* is configured in a circular shape, but may be in other shapes such as a rectangular shape 168. Any ultrasonic emitter may be used which enables generation of parametric sound. The actual number of emitters 170 will depend upon power requirements and the physical dimensions of the loudspeaker housing in which the emitters are enclosed. The ultrasonic signal emitter may also be accomplished using piezoelectric film, as will be discussed more fully below.

As shown in FIG. 1*d*, multiple emitters can be useful in increasing the volume, or sound pressure level (SPL) of a parametric loudspeaker. However, individual ultrasonic transducers are typically limited in the amount of SPL they can produce. To obtain maximum power, ultrasonic transducers have usually been driven at their fundamental resonant frequency, the frequency at which maximum output and electrical efficiency typically occur in an ultrasonic transducer. Further increases in SPL can be obtained by increasing the number of transducers in a loudspeaker. However, it has been discovered that driving the transducers at their fundamental resonant frequency can produce undesirable results due to a wide phase variance inherent in ultrasonic transducers driven at their resonant frequency.

Figure 2A:
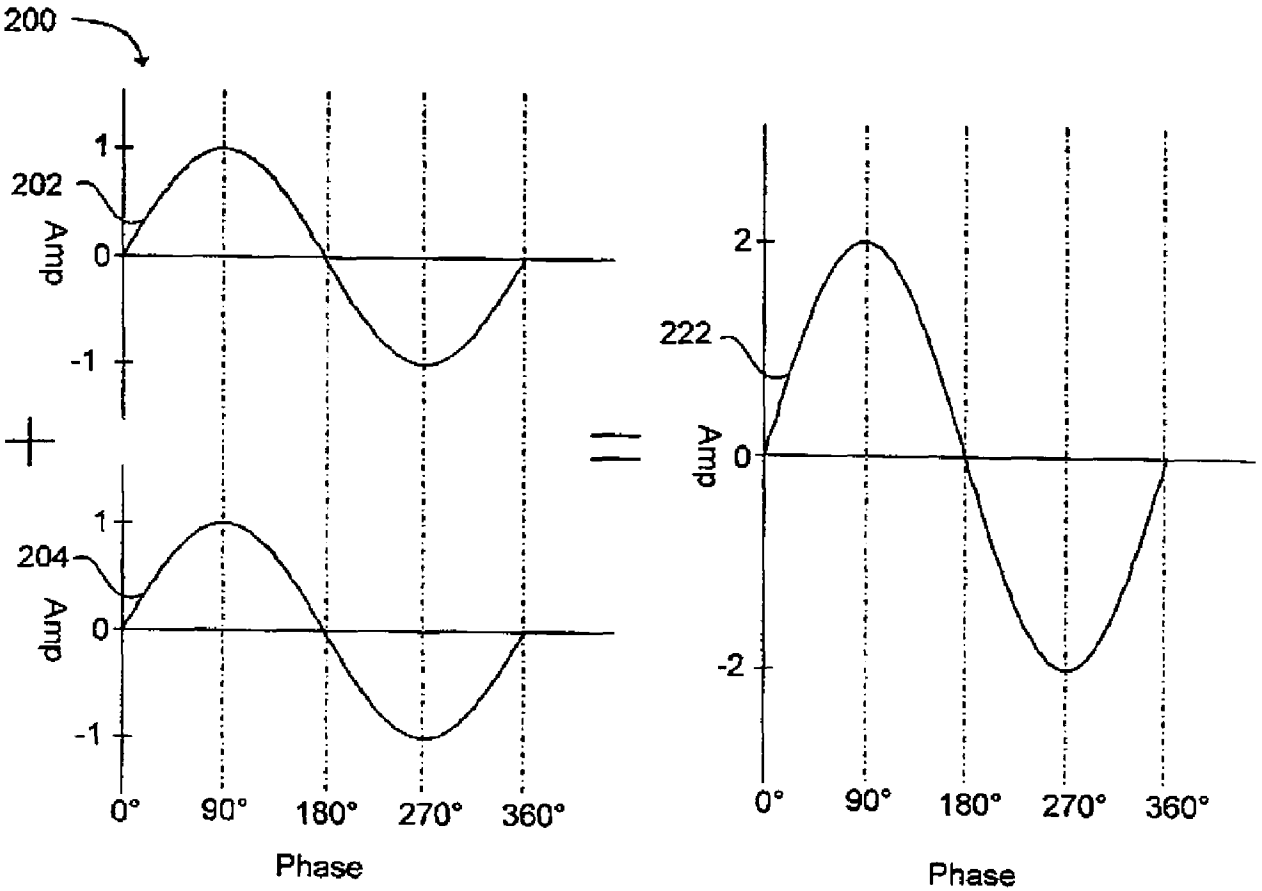
FIG. 2*a* shows a diagram of a summation of two in phase sine waves.

When individual transducers are substantially in phase, the ultrasonic waves generated by the transducers will add proportionally as illustrated in FIG. 2*a*. For example, a plurality of substantially in phase waves 200, represented by sine waves and comprising a first ultrasonic wave 202 emitted by a first transducer and a second ultrasonic wave 204 emitted by a second transducer, will add proportionately, as shown in FIG. 2*a*. At a phase of 90°, the point of maximum amplitude of the waves, each wave has an amplitude of 1. The first and second waves will add proportionally to produce an amplitude of 2 at 90°. At a phase of 180° the waves have an amplitude of 0. The first and second waves will add at 180° to produce an amplitude of 0. At a phase of 270° the waves will add to produce an amplitude of −2. Finally, at a phase of 360° the waves will add to produce an amplitude of 0. Thus, the first ultrasonic wave and second ultrasonic wave will add to produce a sum wave 222 having a sum of the amplitudes of the two waves.

Figure 2B:
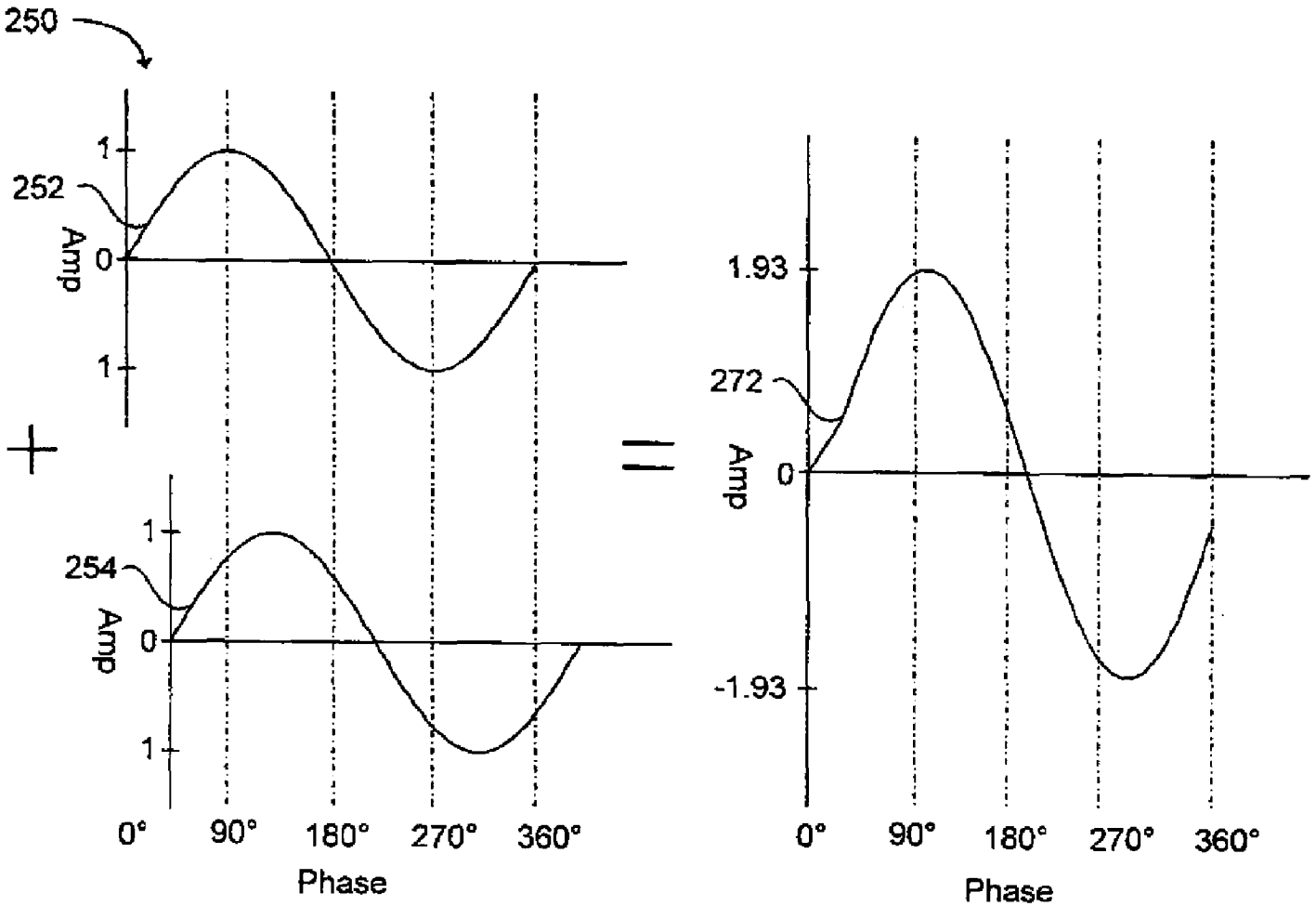
FIG. 2*b* shows a diagram of a summation of two out-of-phase sine waves.

A plurality of out-of-phase waves 250, however, will not add proportionately, as shown in FIG. 2*b*. At 90° the first ultrasonic wave 252 has an amplitude of 1. The second ultrasonic wave 254, which is approximately 30° out-of-phase with the first ultrasonic wave, will have an amplitude of 0.87. Thus, the sum of the waves at 90° will be about 1.87 in this example. The out-of-phase sum wave 272 will actually peak at a phase of about 105° relative to the first wave with an amplitude of 1.93. At 180° the sum wave will have an amplitude of about 0.5. At 270° the sum wave will have an amplitude of approximately −1.87, and at 360° the amplitude will be about −0.5. Thus, the out-of-phase sum wave will have an overall amplitude lower than the sum of the maximum amplitude of the first and second waves if they had been in phase.

The output performance from parametric loudspeakers comprising multiple transducers has not been adequate in prior art systems due to such phase discrepancies. The overall amplitude of a parametric loudspeaker having a plurality of transducers with an ultrasonic parametric signal used to drive each transducer at its resonant frequency typically has an output power which is substantially less than the theoretical amplitude. The decreased amplitude is caused by a wide variance in phase between the multiple transducers. Adding more out-of-phase transducers can actually cause the output per transducer of a parametric loudspeaker to decrease due to the increased number of out-of-phase waves which sum together to produce the overall output amplitude.

Figure 3:
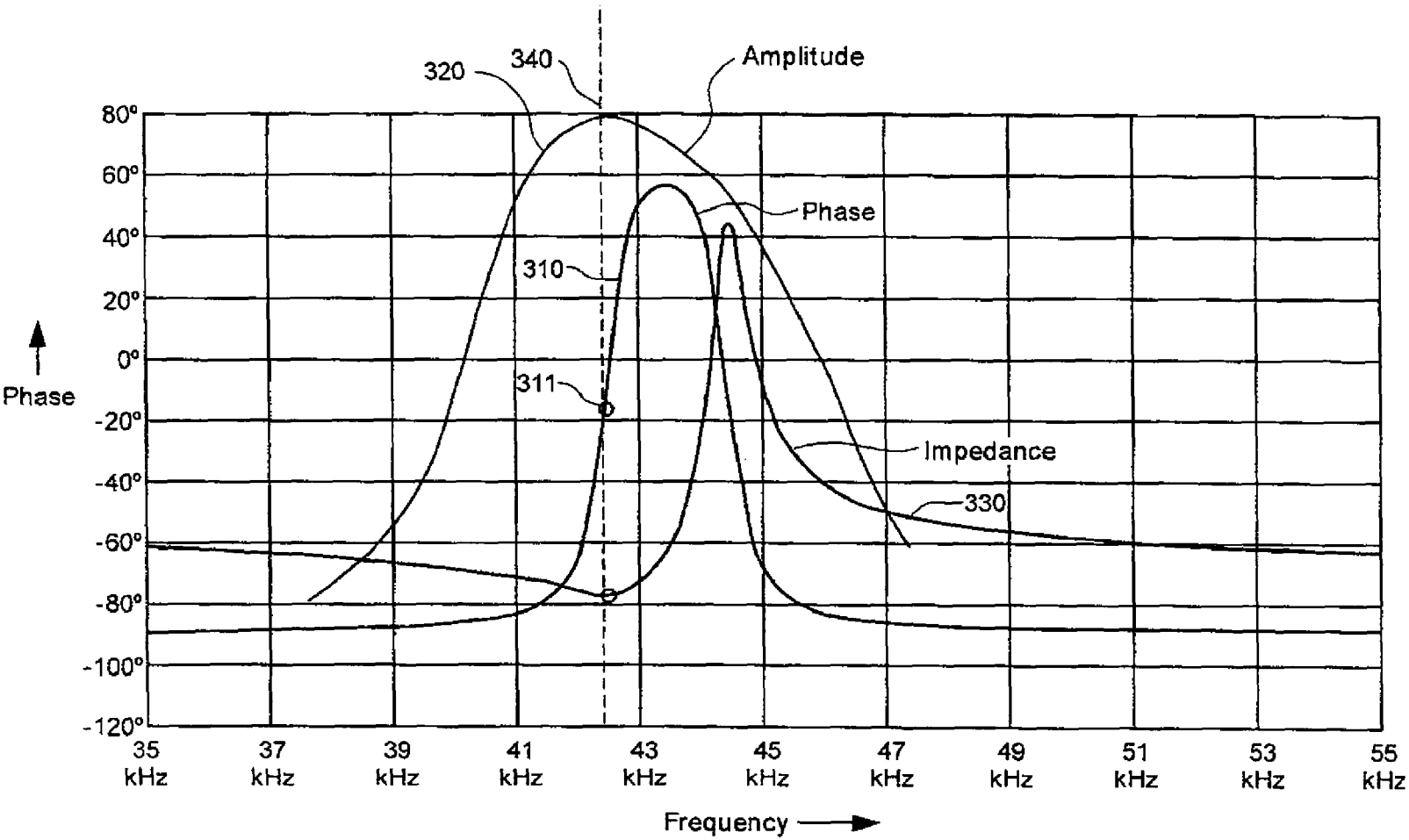
FIG. 3 shows the impedance, phase, and amplitude curves for a typical bimorph transducer with a conventional carrier frequency point.

FIG. 3 shows the performance curves for a selected piezoelectric bimorph transducer used for a parametric loudspeaker. The phase response is represented by curve 310. The amplitude curve 320 and the impedance curve 330 are also shown on the phase diagram to demonstrate their respective frequency responses relative to the phase curve. The resonant frequency of the device occurs at the peak 340 of the amplitude curve 320. In conventional parametric speaker design, it is important to have the maximum carrier output because this in turn generates the maximum audio output, as previously discussed. To produce the maximum carrier output, the carrier signal is set at the frequency at which the transducer produces maximum power, peak 340 in the present example. This is the preferred frequency to set the carrier signal as taught in the prior art.

However, conventional design research has not looked at the phase variance of transducers as compared to a transducer's resonant frequency. Point 311 on the phase curve 310 is also at the resonant frequency, which is the same frequency as the maximum amplitude 340. As can be seen, phase point 311 is at the steepest phase transition point on the phase curve 310. This is typically not a problem when using a single device.

When multiple transducers are used, however, the steep phase transitions can cause dramatic phase differences between any two transducers operating at the same frequency. This is due to phase matching errors which can be caused by physical and electrical variations from device to device.

Bimorph transducers can be useful in parametric speakers due to their ability to actuate a relatively large distance. In a parametric speaker having ultrasonic emitters comprised of bimorph transducers, each individual transducer can have a relatively large ultrasonic output. Even though using multiple bimorph transducers appears to be a good choice for a parametric speaker, the phase relationships of each separate bimorph transducer can be such that the total ultrasonic output of a plurality of the transducers do not add up to the amount predicted by the theoretical summing of all the devices. This can be due to a wide variance in phase between the multiple transducers, as previously discussed. This lack of phase matching can result in reduced audio amplitude over that which is predicted by theoretically summing the output of all the individual devices. These same phase discrepancies can also cause unintentional beam steering which can further reduce output and directivity.

Of course, the use of multiple ultrasonic emitters is most often required by a parametric loudspeaker to produce acceptable volumes. Accordingly, these steep phase transitions cause dramatic phase differences between any two emitters which have even a relatively small variation in frequency. Each ultrasonic emitter can have slight variations from manufacturing conditions, material variations, minor defects, and other uncontrollable variables. Even two emitters which are engineered to be tuned to the same frequency can actually have some variation in the actual frequency they produce. These variations are exaggerated when the carrier frequency is set at the amplitude maximum 340, because of the carrier frequency's relationship to the emitter's phase 310. In other words, a small frequency variation in the emitter produces a large phase change when the carrier signal's frequency is set at the amplitude maximum.

Figure 4:
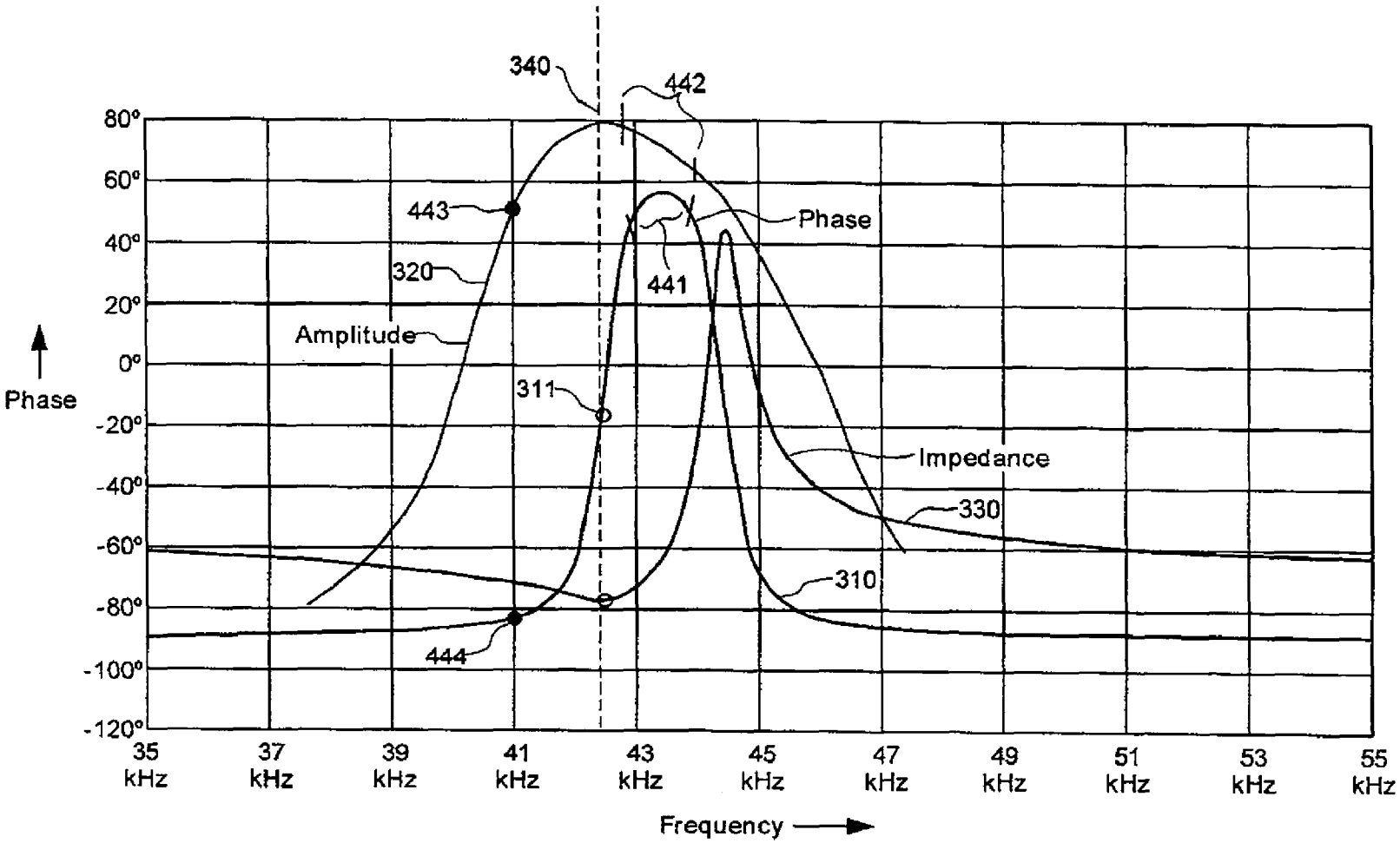
FIG. 4 shows the improved phase characteristics obtained by offsetting the frequency of the carrier signal in accordance with an embodiment of the present invention.

As shown in FIG. 4, the current invention moves the frequency of the carrier signal to the lower amplitude area 442 where the corresponding phase response area of the curve 441 is relatively flat as compared to point 311. The carrier frequency change reduces the significant phase differences between devices operating at essentially the same frequency. This phase selection is effective for increasing the maximum audio output as long as the carrier frequency is set within the approximate range of the window 442. The preferred range for the window is determined by adding 1% to 5% of the maximum resonant frequency 340 to that maximum frequency. It should be noted that the window for the carrier frequency could be greater than 5%, but if the window becomes too large then the carrier frequency setting can have the same problems because it can enter another area of rapid phase change. One frequency amount that can be added to the carrier frequency can be between approximately 400 Hertz to 2000 Hertz. The offset may be greater than 2000 Hertz, if the point at which the carrier frequency is set has a low rate of phase change. The preferred phase change is less than 20 degrees for a corresponding 2½ percent change in frequency. While this is the preferred range, a functional amount of phase shift can be a shift of between 10 to 40 degrees for each 2½ percent change in the frequency of the carrier signal.

Moving the carrier signal to a frequency which produces a lower amplitude is a surprising change because it means that the carrier signal is not at maximum output. It is very important to note that this adjustment to the frequency of the carrier signal actually reduces the maximum output of the individual transducers. So, it is, in fact, counterintuitive to reduce the frequency of the carrier signal because the maximum output is anticipated to be decreased. What actually happens, however, is quite the opposite. The overall output of the group of transducers can be increased when driven at a frequency that is 1% to 5% different than the resonant frequency. This is surprising since the output from the carrier signal has been reduced. Rather than reducing the overall output, the SPL from the collective ultrasonic transducers can actually be increased. The reason for this advantage is the relative phase coherence of the transducers is substantially increased by moving the carrier signal to an operating frequency having a flatter phase response.

This system of moving the frequency of the carrier signal as described above is also effectively used with double sideband signals and similarly well known signal configurations. An alternative embodiment of the speaker can use a single sideband signal or a truncated double sideband signal. Referring again to FIG. 4, when a single sideband signal is used the frequency of the carrier signal can be set to operate on the lower frequency side of the amplitude curve 320. For a single sideband signal, the carrier frequency can be set at approximately point 443 which corresponds to point 444 on phase curve 310. The advantage of setting the carrier frequency at approximately point 443 is that it corresponds to an area of the phase curve 310 which has a lower rate of change. It can be seen that the phase curve 310 is flatter in the area of point 444, which is similar to the window area 442. A window of optimum phase response and output can also be setup around point 443 which can have a similar but slightly smaller width than the window 442. In this case, a window is determined around point 443 by subtracting 3%-5% of the amount of the maximum resonant frequency 340 from the maximum resonant frequency.

FIG. 5 shows a table comparing the parametric output of bimorphs which are conventionally phased and bimorphs which have improved phase characteristics. The first line of the table depicts a single piezoelectric bimorph which delivers 120 dB of ultrasonic output and 50 dB of audio output. The parametric output is the audible sound which is decoupled from the ultrasonic output in the nonlinear medium of air. Because of the phase problems stated above, the expected cumulative performance does not translate proportionally to multiple devices because each device may have a slightly different resonant frequency. The fourth line in the table shows that the theoretical ideal summed output of 100 of the same devices is shown to be 140 dB of ultrasonic output and 90 dB of parametric output. The second entry in the table shows that a transducer array, which does not use phase optimization, delivers 134 dB of ultrasonic output and 78 dB of parametric output. This is a 6 dB and a 12 dB loss compared to the theoretical output for 100 devices.

Line 3 of the table shows 100 transducers which use the optimized phase configuration of the present invention. A phase optimized system with the current invention's techniques delivers 139 dB of ultrasonic output and 88 dB of parametric output. This is a significant improvement over the prior art and approaches the theoretically lossless ideal.

Figure 6A:
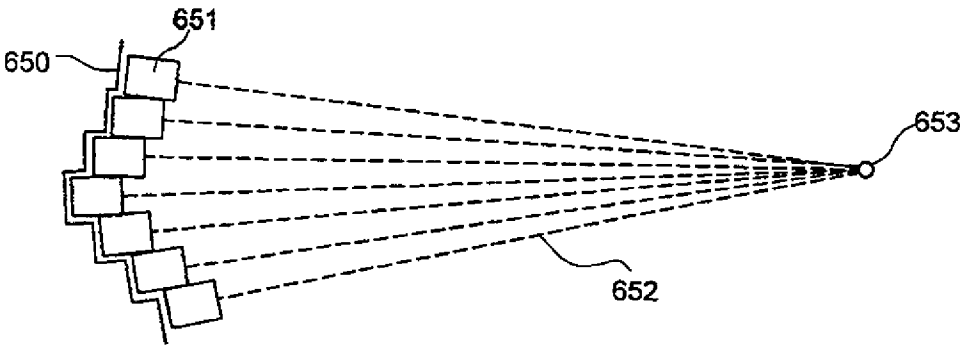
FIG. 6*a* shows an improved alignment for multiple transducers using a step configuration in accordance with an embodiment of the present invention.

Emitters used for a parametric speaker may also be optimized to reduce the phase shift between separate devices by using an optimal physical arrangement. An effective arrangement is to arrange the emitters in a somewhat curved arrangement so that the output from each transducer is directed to the same spatial point. FIG. 6*a* shows a side view of a parametric speaker constructed such that individual emitters 651 are mounted on a stepped plate 650. The emitters can face substantially forward with all faces substantially directed toward a common predetermined point 653 to provide equal length paths 652 to the point 653. Because the length of the paths will be equal, each of the ultrasonic wavefronts which reach the point can have substantially the same phase. In contrast, when a group of emitters is mounted on a planar surface some emitters have a longer distance to travel to an individual point.

Differences in distance can cause the waves to be phase shifted, or out-of-phase relative to a point from the parametric speaker. This is especially noticeable with an ultrasonic system because the original wavelengths are relatively short when compared to a conventional audio system. At 40 kHz, an ultrasonic signal has a wavelength of approximately one third of an inch. Even a small difference in path length between emitters can cause significant phase differences which can cause the addition of outputs to be significantly decreased and produce a lesser output.

Another problem which exists if the emitters are different distances from the target point is that phase shifting may cause beam steering which can be heard by a listener. It should also be apparent from this disclosure that some other mounting means could be used to configure the emitters and avoid unwanted phase shift distortion. For example, the ultrasonic emitters could be affixed together with an adhesive in a non-planar manner or attached to a pronged device with a different prong length for each transducer.

Figure 6B:
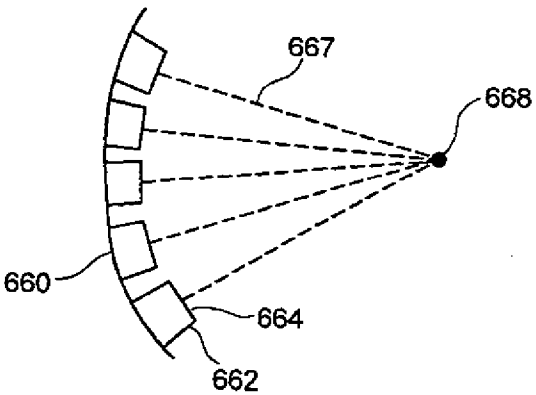
FIG. 6*b* shows an improved alignment for multiple transducers using a curve in accordance with an embodiment of the present invention.
Figure 6C:
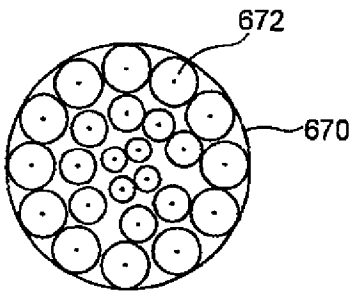
FIG. 6*c* shows a frontal view of FIGS. 6*a* and 6*b;*

FIG. 6*b* shows a side view of a parametric speaker constructed with the individual ultrasonic emitters 662 mounted on a curved concave plate 660 or base and facing substantially inward with all of the faces 664 angled to provide equal length paths 667 to a predetermined distance point 668. It should also be realized that a convex plate can be used to disperse the parametric output. FIG. 6*c* is a frontal view of FIGS. 6*a* and 6*b* showing the individual transducers 672 mounted on back plate 670. The predetermined distance point 668 should be far enough away from the transducers to allow for the parametric interaction to take place. The minimum effective distance that the emitters should be focused for is 0.33 meters. It is preferred that the distance point 668 be between 0.33 meters and 3 meters from the emitters. This is because a person listening to the speakers will be at approximately 0.33 meters to 3 meters. Of course, the distance used could also be slightly less or somewhat greater.

Figure 7B:
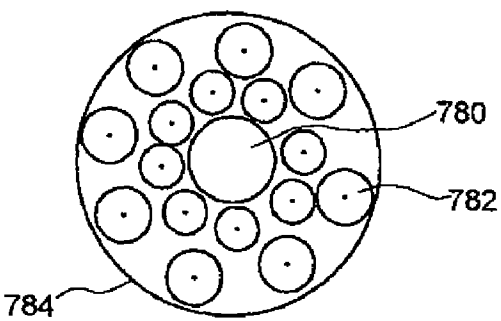
FIG. 7*b* shows a frontal view of FIG. 7*a;*
Figure 7A:
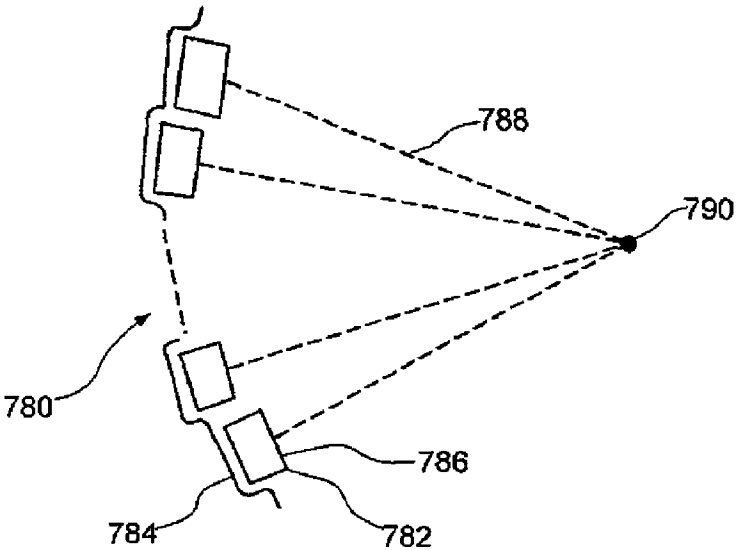
FIG. 7*a* shows the improved alignment of multiple transducers with a step configuration and an open center in accordance with an embodiment of the present invention.

The parametric device illustrated in FIG. 7*a* has a similar construction to FIG. 6*a* but with an open section in the middle 780 allowing the multiple ultrasonic emitters 782 to form an open ring, similar to the parametric ring emitter 166 shown in FIG. 1*d*. The individual emitters 782 are mounted on stepped plate 784 and face substantially forward with all faces 786 substantially parallel to provide equal length paths 788 to a predetermined spatial point 790. FIG. 7*b* is a frontal view of the device in FIG. 7*a* showing individual emitters 782 mounted on back plate 784 with an open center 780 allowing the emitters to form an open ring structure. This configuration has the same advantage as FIGS. 6*a*-6*c* because it creates equal path lengths to a point. Another distinct advantage of the configuration shown in FIG. 7*a* is that it can produce 80% to 90% as much output as a speaker which has an active center area. The configuration shown in FIG. 7*a*, however, can have 40 to 50% fewer bimorph transducers as compared to a ring with an active center area, with only a 10% to 20% decrease in output. The actual output depends on the size of the ring and size of the open center portion.

The present invention can also be realized using a single emitter comprising an emitter film. Various types of film may be used as the emitter film. The important criteria are that the film be capable of responding to an applied electrical signal to constrict and extend in a manner that reproduces an ultrasonic output corresponding to the signal content. Although piezoelectric materials are the primary materials that supply these design elements, new polymers are being developed that are technically not piezoelectric in nature. Nevertheless, the polymers are electrically sensitive and mechanically responsive in a manner similar to the traditional piezoelectric compositions. Accordingly, it should be understood that reference to piezoelectric films in this application is intended to extend to any suitable film that is both electrically sensitive and mechanically responsive (ESMR) so that ultrasonic waves can be realized from the subject transducer.

A parametric loudspeaker with improved phase characteristics can be realized using at least two electro-acoustical emitters. The electro-acoustical emitters can comprise two or more transducers, or a single emitter film having two or more emission zones. As used herein, emission zone can include an ultrasonic transducer or a portion of an emitter film driven at an ultrasonic frequency. Each emission zone on the emitter film can be driven independently with an electrical connection coupled to each emission zone. Emission zones can be driven at a frequency offset from the film's resonant frequency, where the slope of the phase is relatively flat when compared to the slope of the phase at the emitter film's resonant frequency. Parametric loudspeakers having a plurality of electro-acoustical emitters which are driven at a frequency offset from the resonant frequency can have a flattened phase response.

The flattened phase response can enable more accurate control of phased arrays. Phased arrays of transducers or emission zones can be created to electronically focus or steer the audio output. A parametric phased array typically comprises a parametric speaker having one or more groups of electro-acoustical emitters which are out-of-phase with other groups of electro-acoustical emitters. By controlling the phase of the different groups of emitters, an increased amount of the parametric loudspeaker output can be directed to a predetermined location.

Figure 8A:
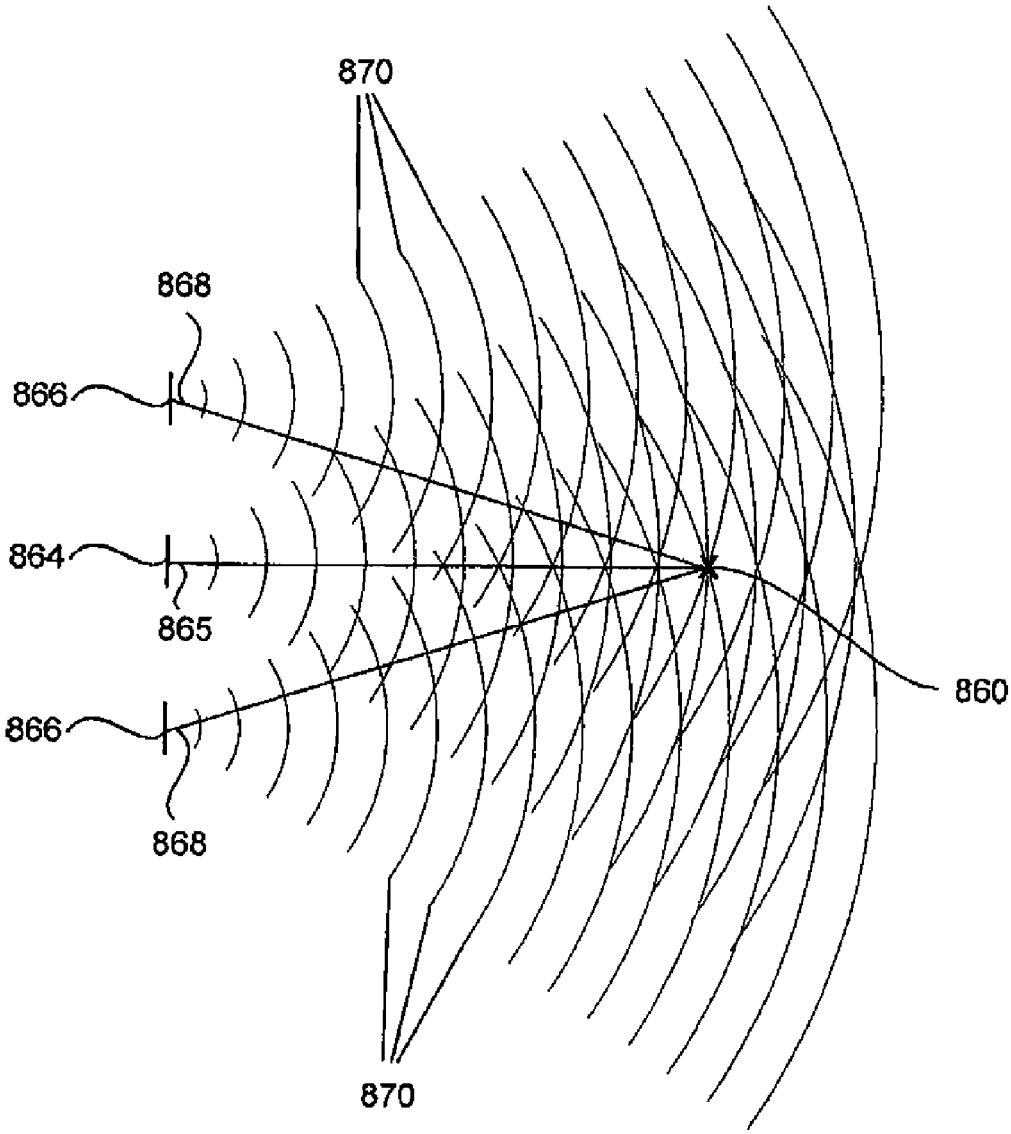
FIG. 8*a* shows an illustration of beam focusing in accordance with an embodiment of the present invention.

A simple example of beam focusing is shown in FIG. 8*a*. A center emission zone 864 can emit sound waves, or wavefronts 870 represented by parabolic lines, into the surrounding medium. Similarly, the outer emission zones 866 emit sound waves into the surrounding medium. The sound waves from each of the emission zones interact, resulting in waves adding and subtracting, as was discussed previously in FIGS. 2 and 3. The waves can add or subtract depending upon each of the interacting wave's phase. If the waves are in phase they can add to create a larger wave. If the waves are out-of-phase with one another, they can subtract, resulting in the creation of a smaller wave, or a wave having a smaller amplitude. In the present example the waves are shown to add when the wavefronts 870 cross.

By controlling the phase of the waves as they are emitted from each of the emission zones 864 and 866, the locations where the waves add and subtract can be controlled. In the present example, the phase of the emission zones can be adjusted so that the waves will add constructively at a focus point 860. The center path length 865 between the center emission zone 864 and the focus point can be determined. The center emission zone can be configured to emit sound waves starting at a predetermined phase, such as zero degrees. The outer path length 868 from the outer emission zones 866 to the focus point can then be determined. The difference in path length can be compensated for by physically moving the emitter source so that the phases match, or by electronically altering the phase of the sound waves emitted from the outer emitters with respect to the sound waves emitted by the center emission zone.

For example, the difference in path length between the center path length 865 and the outer path lengths 868 may be three inches. Thus, the sound waves emitted from the outer emission zones 866 will have to travel three inches farther than the sound waves from the center emission zone 864. The wavelength of sound can be determined according to the equation:

$$\lambda = \frac{V_s}{f},$$

wherein $\lambda$ is the wavelength of the sound, $V_s$ is the velocity of sound in air, and f is the frequency of the sound. At sea level, the velocity of sound in air is approximately 1130 feet per second. Thus, for sound waves produced at a frequency of 2,260 Hz, the wavelength of the sound is 0.5 feet, or six inches. As shown in FIG. 2, a full wave consists of a wave varying in phase from 0 degrees to 360 degrees. Thus, by offsetting the outer path length by a phase of half a wavelength, or 180 degrees, the extra three inch path length traveled by the sound waves emitted from the outer emission zones is compensated for, allowing sound from all three emission zones to reach the focal point when the sound waves are in phase. The in phase waves can add, or constructively interfere, at the desired focal point 860. Similarly, the desired focal point can be moved to a different location by adjusting the phase of the emission zones. Moving the desired focal point where the waves constructively interfere by electrically changing the phase of one or more of the emission zones is often referred to as beam steering.

Figure 8B:
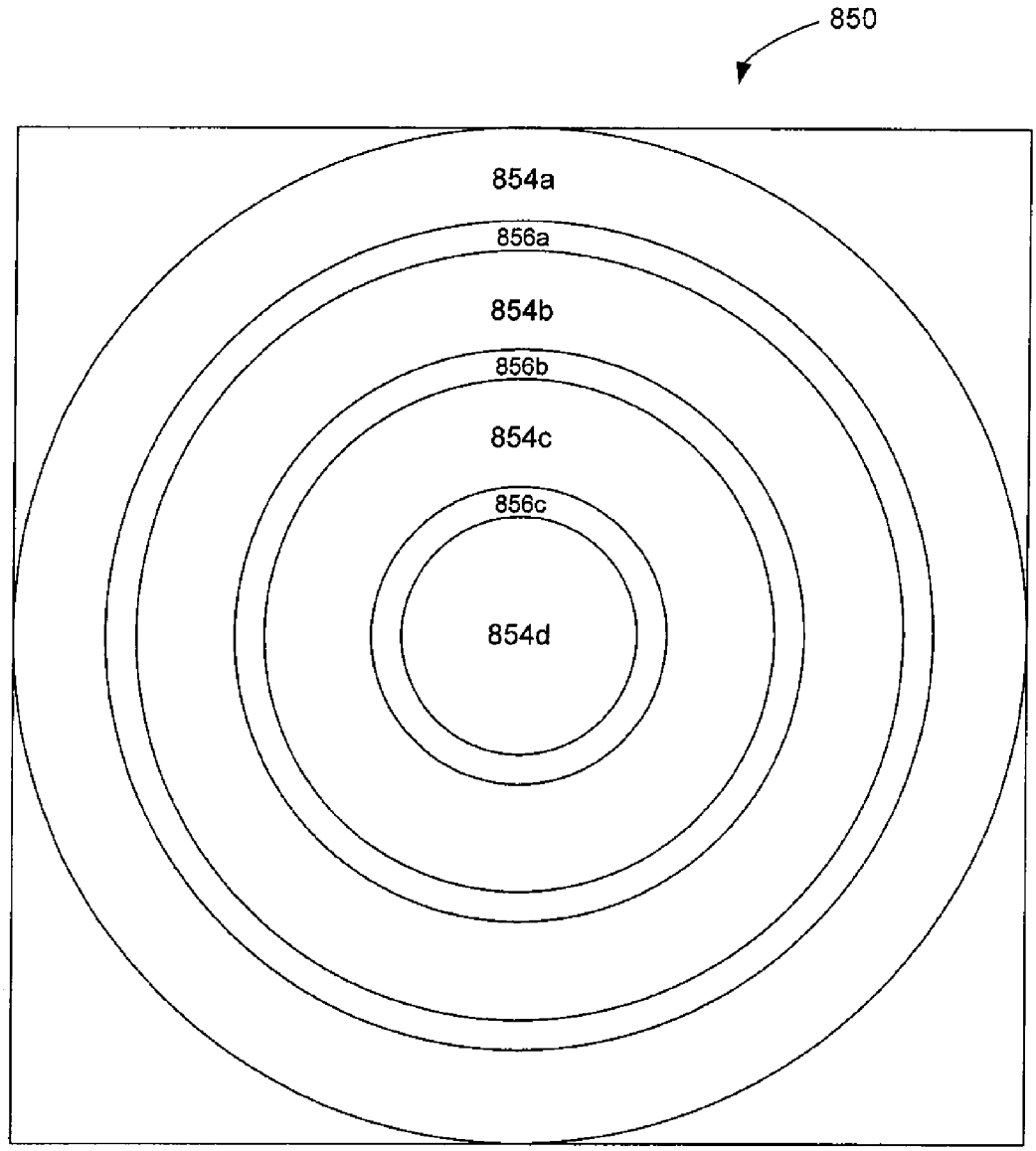
FIG. 8*b* shows a diagram of a phased array speaker having concentric circles in accordance with an embodiment of the present invention.

An example of a parametric transducer, as illustrated in FIG. 8*b*, will now be provided. This example transducer is designed to create a focalizing area at 36 inches from the front surface of the transducer, using a carrier signal having a frequency of 46 kHz. An ESMR film can be mounted on a 14" square support member. The ESMR film comprises a plurality of emission zones which have radii of 2.3" (inner circle), 4", 5.16", 6.1", 6.9", and 7.68" respectively (extending into the corners of the support member, and being cut off on the edges). To achieve maximum output and focus at the 36 inch distance, the emission zones are phased such that the center portion and each odd numbered section/ring are at zero phase reference and each even ordered section/ring is operated 180 degrees out-of-phase compared to the zero phase reference.

The emission zones of the parametric speaker shown in FIG. 8*b* may be comprised of a variety of emitter types. For example, two or more parametric ring emitters, as shown in FIG. 1*d*, each with a plurality of bimorph transducers, can be configured as a phased array emitting parametric ultrasonic waves. As above, odd and even numbered rings can be 180 degrees out-of-phase compared to a zero phase reference.

All the adjacent isolated emission zones can be positioned on a single plane, as shown in FIG. 8*b*. The emission zone 854*d* can be set at 0° phase, emission zone 854*c* can be set at 90° phase, and emission zone 854*b* can be set at 180° phase, emission zone 854*a* can be set at 270° phase, and assuming there was an additional concentric emission zone on the exterior of the emitter 850, it would be set at 360° phase (or 0° phase). Because the phase increments are only 90° in the present example, instead of the 180° increments in the previous example, the sizes of each emission zone will have to be adjusted in order to ensure that the majority of the parametric ultrasonic waves emitted from the emission zones will still arrive at the focalizing area within 90° of one another.

Figure 9:
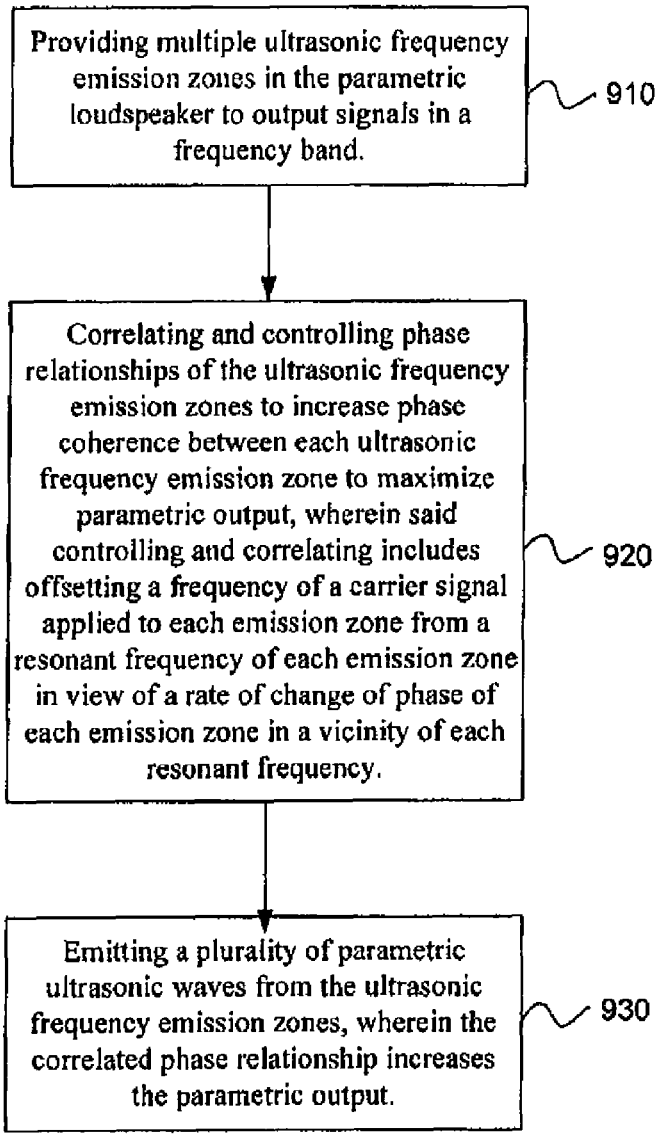
FIG. 9 is a flow chart depicting a method for increasing a parametric output of a parametric loudspeaker system in accordance with an embodiment of the present invention.

Another aspect of the present invention provides a method for increasing a parametric output of a parametric loudspeaker system, as illustrated in FIG. 9. The method includes the operation of providing multiple ultrasonic frequency emission zones in the parametric loudspeaker to output signals in a frequency band, as shown in block 910. The multiple electro-acoustical emitters can comprise multiple transducers. In one embodiment, piezoelectric transducers, such as bimorph transducers can be used. The multiple electro-acoustical emitters may also comprise ESMR films, such as piezoelectric film.

A further operation involves correlating and controlling phase relationships of the ultrasonic frequency emission zones to increase phase coherence between each ultrasonic frequency emission zone to maximize parametric output, wherein said controlling and correlating includes offsetting a frequency of a carrier signal applied to each emission zone from a resonant frequency of each emission zone in view of a rate of change of phase of each emission zone in a vicinity of each resonant frequency, as shown in block 920. As previously discussed, offsetting the frequency of the carrier signal from the resonant frequency of each electro-acoustical emitter can produce a flatter phase characteristic, in which the change in phase per change in frequency has a reduced slope. By reducing the slope, the electro-acoustical emitters can have phases that are more closely aligned. Another operation includes emitting a plurality of parametric ultrasonic waves from the ultrasonic frequency emission zones, wherein the correlated phase relationship increases the parametric output, as shown in block 930.

Figure 10:
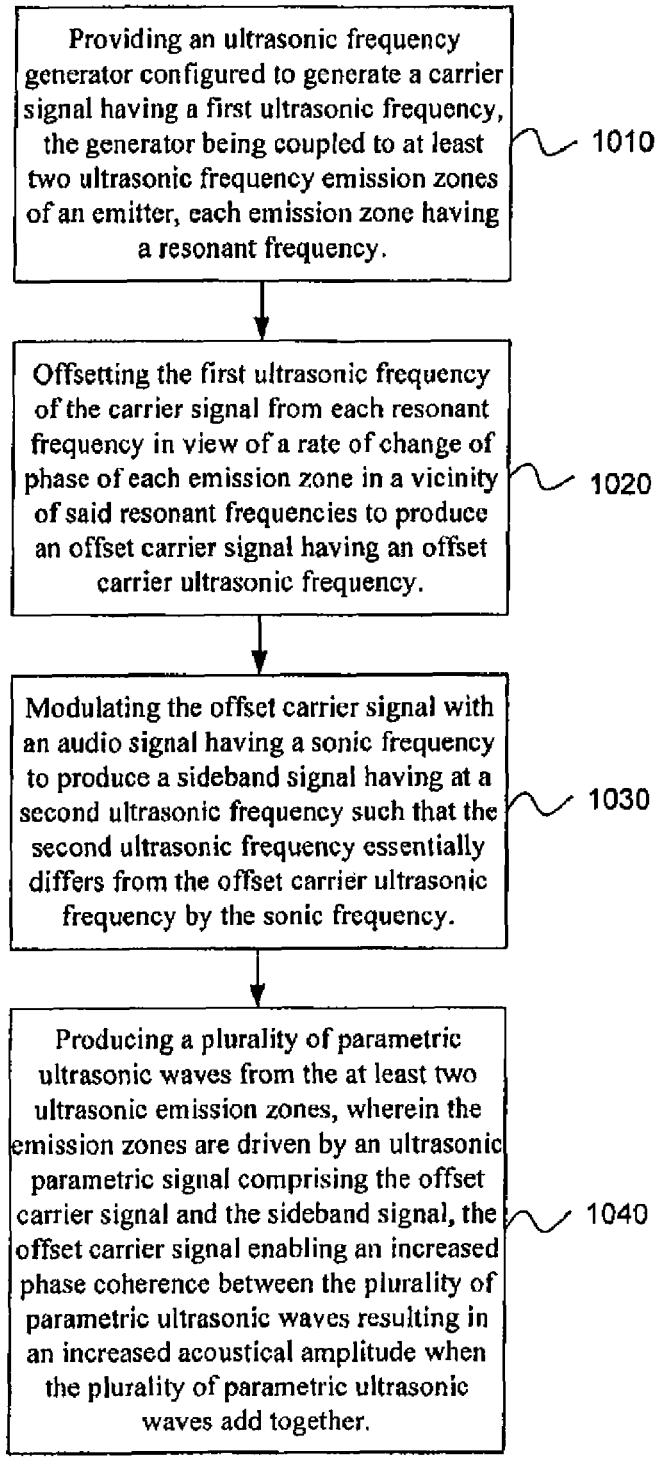
FIG. 10 is a flow chart depicting a further method for increasing parametric output of a parametric loudspeaker system in accordance with an embodiment of the present invention.

A further aspect of the invention provides an additional method for increasing a parametric output of a parametric loudspeaker system, as illustrated in the block diagram of FIG. 10. The method includes the operation of providing an ultrasonic frequency generator configured to generate a carrier signal having a first ultrasonic frequency, the generator being coupled to at least two ultrasonic frequency emission zones of an emitter, each emission zone having a resonant frequency, as shown in block 1010. Another operation includes offsetting the first ultrasonic frequency of the carrier signal from each resonant frequency in view of a rate of change of phase of each emission zone in a vicinity of said resonant frequencies to produce an offset carrier signal having an offset carrier ultrasonic frequency, as shown in block 1020. The carrier signal is offset from the resonant frequency to provide a lower rate of change of phase in order to increase the phase coherence of the electro-acoustical emitters.

A further operation involves modulating the offset carrier signal with an audio signal having a sonic frequency to produce a sideband signal having at a second ultrasonic frequency such that the second ultrasonic frequency essentially differs from the offset carrier ultrasonic frequency by the sonic frequency, as shown in block 1030. Another operation involves producing a plurality of parametric ultrasonic waves from the at least two ultrasonic emission zones, wherein the emission zones are driven by an ultrasonic parametric signal comprising the offset carrier signal and the sideband signal, the offset carrier signal enabling an increased phase coherence between the plurality of parametric ultrasonic waves resulting in an increased acoustical amplitude when the plurality of parametric ultrasonic waves add together, as shown in block 1040. The combined parametric output of the emitters can be increased due to the increase in phase coherence between the electro-acoustical emitters.

In summary, parametric loudspeakers can enable the production of directional sound. Multiple electro-acoustical emitters can be used to increase the sound pressure level produced by a parametric loudspeaker. To achieve the maximum sound pressure level from a parametric loudspeaker, the frequency of the carrier signal at which each electro-acoustical emitter operates can be offset from the electro-acoustical emitter's resonant frequency. Counterintuitively, offsetting the carrier frequency reduces the efficiency and output of each individual electro-acoustical emitter, but it can increase the overall sound pressure level produced by multiple devices. This is due to a flatter phase response from each electro-acoustical emitter when it is driven at a frequency offset from the resonant frequency. The flatter phase response allows the multiple electro-acoustical emitter outputs to sum together and produce an overall greater output, despite the decreased individual output. The physical placement of each individual electro-acoustical emitter in a parametric loudspeaker can also help to ensure that the multiple outputs will be substantially in phase at a predetermined area. Offsetting the carrier frequency and arranging the parametric ultrasonic devices can also allow phased arrays to be more efficient, as the phase of each electro-acoustical emitter can be more accurately controlled. The multiple electro-acoustical emitters can comprise a plurality of individual ultrasonic transducers or a single emitter film driven at a plurality of ultrasonic emission zones.

It is to be understood that the above-referenced arrangements are illustrative of the application for the principles of the present invention. Numerous modifications and alternative arrangements can be devised without departing from the spirit and scope of the present invention while the present invention has been shown in the drawings and described above in connection with the exemplary embodiments(s) of the invention. It will be apparent to those of ordinary skill in the art that numerous modifications can be made without departing from the principles and concepts of the invention as set forth in the examples.

What is claimed is:

1. A parametric loudspeaker system, comprising:

an electronic modulator, adapted to receive audio signals, wherein the electronic modulator generates a carrier signal to be modulated with the audio signals to produce a modulated signal; and at least one electro-acoustical emitter having at least two ultrasonic frequency emission zones coupled to the electronic modulator to reproduce the modulated signal, the at least two ultrasonic frequency emission zones each having at least one resonant frequency, wherein a center frequency of the carrier signal is offset from each at least one resonant frequency in view of a rate of change of phase of each emission zone in a vicinity of each at least one resonant frequency in order to increase a phase coherence and combined parametric output of said emission zones.

2. The parametric loudspeaker system as defined in claim 1 wherein the carrier signal is centered at a frequency where a rate of phase change for an ultrasonic frequency emission zone is less than 40 degrees phase shift for each 2½ percent shift in frequency.

3. The parametric loudspeaker system as defined in claim 1 wherein the carrier signal is centered at a frequency that is divergent from the at least one resonant frequency of each ultrasonic frequency emission zones by 1% to 3%.

4. A parametric loudspeaker system, comprising:

an ultrasonic frequency generator configured to produce a carrier signal having a first ultrasonic frequency;

a modulator coupled to the ultrasonic frequency generator and configured to modulate an audio signal centered at a sonic frequency with the carrier signal to produce a sideband signal centered at a second ultrasonic frequency so that the second ultrasonic frequency differs from the first ultrasonic frequency by the sonic frequency; and an emitter having at least two ultrasonic frequency emission zones, each emission zone coupled to the modulator and ultrasonic frequency generator, the at least two ultrasonic frequency emission zones having a resonant frequency and configured to produce a plurality of ultrasonic parametric waves driven by an ultrasonic parametric signal comprising the carrier signal and the sideband signal, wherein the first ultrasonic frequency of the carrier signal is offset from the resonant frequency of the at least two ultrasonic frequency emission zones in view of a rate of change of phase of each ultrasonic frequency emission zone in a vicinity of the resonant frequency of each ultrasonic frequency emission zone in order to increase a phase coherence and combined parametric output of said ultrasonic frequency emission zones.

5. The parametric loudspeaker system of claim 1, wherein the first ultrasonic frequency of the carrier signal is offset from a fundamental resonant frequency of each ultrasonic frequency emission zone.

6. The parametric loudspeaker system of claim 5, wherein the first ultrasonic frequency of the carrier signal is offset from a harmonic of the fundamental resonant frequency of each ultrasonic frequency emission zone.

7. The parametric loudspeaker system of claim 1, wherein the at least two ultrasonic frequency emission zones comprise at least two piezoelectric transducers.

8. The parametric loudspeaker system of claim 1, wherein the at least two ultrasonic frequency emission zones comprise one or more electrically sensitive and mechanically responsive (ESMR) film.

9. The parametric loudspeaker system of claim 8, wherein the one or more ESMR films is comprised of a piezoelectric film.

10. The parametric loudspeaker system of claim 1, wherein the first ultrasonic frequency of the carrier signal is offset from the resonant frequency of each ultrasonic frequency emission zone by a frequency of at least 1% of the first ultrasonic frequency.

11. The parametric loudspeaker system of claim 1, wherein the first ultrasonic frequency of the carrier signal is offset from the resonant frequency of each ultrasonic frequency emission zone by a frequency of 1% to 3% of the first ultrasonic frequency.

12. The parametric loudspeaker system of claim 1, wherein the first ultrasonic frequency of the carrier signal is offset from the resonant frequency of each ultrasonic frequency emission zone by a frequency of 2% to 4% of the first ultrasonic frequency.

13. The parametric loudspeaker system of claim 1, wherein the first ultrasonic frequency of the carrier signal is offset from the resonant frequency of each ultrasonic frequency emission zone by up to 5% of the first ultrasonic frequency.

14. The parametric loudspeaker system of claim 1, wherein the first ultrasonic frequency of the carrier signal is offset from the resonant frequency of each ultrasonic frequency emission zone by at least 400 Hertz.

15. The parametric loudspeaker system of claim 1, wherein the first ultrasonic frequency of the carrier signal is offset from the resonant frequency of each ultrasonic frequency emission zone by up to 2000 Hertz.

16. The parametric loudspeaker system of claim 1, wherein the first ultrasonic frequency of the carrier signal is offset from the resonant frequency of each ultrasonic frequency emission zone by 400 Hertz to 2000 Hertz.

17. The parametric loudspeaker system of claim 1, wherein the first ultrasonic frequency of the carrier signal is placed at a frequency where a rate of phase change for an ultrasonic frequency emission zone is less than 40 degrees phase shift for each 2½ percent shift in frequency.

18. The parametric loudspeaker system of claim 17, wherein the ultrasonic frequency emission zone is a bimorph transducer.

19. The parametric loudspeaker system of claim 17, wherein the ultrasonic frequency emission zone is an ESMR film.

20. The parametric loudspeaker system of claim 1, wherein the first ultrasonic frequency of the carrier signal is placed at a frequency where a rate of phase change for an ultrasonic frequency emission zone is less than 20 degrees phase shift for each 2½ percent shift in frequency of the first ultrasonic frequency.

21. The parametric loudspeaker system of claim 20, wherein the ultrasonic frequency emission zone is a bimorph transducer.

22. The parametric loudspeaker system of claim 20, wherein the ultrasonic frequency emission zone is an ESMR film.

23. The parametric loudspeaker system of claim 1, wherein the first ultrasonic frequency of the carrier signal is placed at a frequency where a rate of phase change for an ultrasonic frequency emission zone is between 10 degrees to 40 degrees phase shift for each 2½ percent shift in frequency.

24. The parametric loudspeaker system of claim 23, wherein the ultrasonic frequency emission zone is a bimorph transducer.

25. The parametric loudspeaker system of claim 23, wherein the ultrasonic frequency emission zone is an ESMR film.

26. The parametric loudspeaker system of claim 1, wherein the first ultrasonic frequency of the carrier signal is placed at a frequency where a rate of phase change for an ultrasonic frequency emission zone is less than 40 degrees phase shift for each 2½ percent shift in frequency.

27. The parametric loudspeaker system of claim 26, wherein the ultrasonic frequency emission zone is a bimorph transducer.

28. The parametric loudspeaker system of claim 26, wherein the ultrasonic frequency emission zone is an ESMR film.

29. The parametric loudspeaker system of claim 1, further comprising two or more groups of ultrasonic frequency emission zones, wherein each group comprises a plurality of ultrasonic frequency emission zones, wherein each group is configured to be out-of-phase with remaining groups by a predetermined amount.

30. The parametric loudspeaker system of claim 29, wherein each group is arranged in a ring configuration.

31. The parametric loudspeaker system of claim 29, wherein each group is arranged in a concentric ring configuration having two or more concentric rings.

32. The parametric loudspeaker system of claim 31, wherein each concentric ring is placed on a substantially similar plane.

33. The parametric loudspeaker system of claim 31, wherein the concentric rings are divided into a first group and a second group, with the first and second group approximately 180 degrees out-of-phase.

34. The parametric loudspeaker system of claim 1, further comprising:

a non-planar base; and at least two ultrasonic frequency emission zones mounted on the non-planar base, wherein the at least two ultrasonic frequency emission zones are individually aligned substantially equidistant to a point located both forward from and centered on the non-planar base.

35. The parametric loudspeaker system of claim 34, wherein the point located both forward from and centered on the non-planar base is at a distance of greater than 0.33 meters.

36. The parametric loudspeaker system of claim 34, wherein the point located both forward from and centered on the non-planar base is at a distance of less than 3.0 meters.

37. The parametric loudspeaker system of claim 34, wherein the point located both forward from and centered on the non-planar base is at a distance between 0.33 to 3.0 meters.

38. The parametric loudspeaker system of claim 1, further comprising:

a non-planar base; and an array of ultrasonic frequency emission zones mounted on the non-planar base, wherein the array of ultrasonic frequency emission zones are individually aligned substantially equidistant to a point located both forward from and centered on the array of ultrasonic frequency emission zones.

39. The parametric loudspeaker system of claim 38, wherein the point located both forward from and centered on the array of ultrasonic frequency emission zones is at a distance of greater than 0.33 meters.

40. The parametric loudspeaker system of claim 38, wherein the point located both forward from and centered on the array of sound emission areas is at a distance of greater than 3.0 meters.

41. The parametric loudspeaker system of claim 38, wherein the point located both forward from and centered on the array of ultrasonic frequency emission zones is at a distance between 0.33 to 3.0 meters.

42. A method for increasing a parametric output of a parametric loudspeaker system, comprising the steps of:

providing multiple ultrasonic frequency emission zones in the parametric loudspeaker to output signals in a frequency band;

correlating and controlling phase relationships of the ultrasonic frequency emission zones to increase phase coherence between each ultrasonic frequency emission zone to maximize parametric output, wherein said controlling and correlating includes offsetting a frequency of a carrier signal applied to each emission zone from a resonant frequency of each emission zone in view of a rate of change of phase of each emission zone in a vicinity of each resonant frequency; and emitting a plurality of parametric ultrasonic waves from the ultrasonic frequency emission zones, wherein the correlated phase relationship increases the parametric output.

43. A method for increasing a parametric output of a parametric loudspeaker system, comprising the steps of:

providing an ultrasonic frequency generator configured to generate a carrier signal having a first ultrasonic frequency, the generator being coupled to at least two ultrasonic frequency emission zones of an emitter, each emission zone having a resonant frequency;

offsetting the first ultrasonic frequency of the carrier signal from each resonant frequency in view of a rate of change of phase of each emission zone in a vicinity of said resonant frequencies to produce an offset carrier signal having an offset carrier ultrasonic frequency;

modulating the offset carrier signal with an audio signal having a sonic frequency to produce a sideband signal having at a second ultrasonic frequency such that the second ultrasonic frequency essentially differs from the offset carrier ultrasonic frequency by the sonic frequency; and producing a plurality of parametric ultrasonic waves from the at least two ultrasonic emission zones, wherein the emission zones are driven by an ultrasonic parametric signal comprising the offset carrier signal and the sideband signal, the offset carrier signal enabling an increased phase coherence between the plurality of parametric ultrasonic waves resulting in an increased acoustical amplitude when the plurality of parametric ultrasonic waves add together.

44. The method as in claim 43, wherein offsetting the first ultrasonic frequency further comprises the step of offsetting the first ultrasonic frequency of the carrier signal from each resonant frequency by at least 1%.

45. The method as in claim 43, wherein offsetting the first ultrasonic frequency further comprises the step of offsetting the first ultrasonic frequency of the carrier signal from each resonant frequency by up to 5%.

46. The method as in claim 43, wherein offsetting the first ultrasonic frequency further comprises the step of offsetting the first ultrasonic frequency of the carrier signal from each resonant frequency by 2% to 4%.

47. The method as in claim 43, wherein offsetting the first ultrasonic frequency further comprises the step of offsetting the first ultrasonic frequency of the carrier signal from each resonant frequency by at least 400 Hertz.

48. The method as in claim 43, wherein offsetting the first ultrasonic frequency further comprises the step of offsetting the first ultrasonic frequency of the carrier signal from each resonant frequency by up to 2000 Hertz.

49. The method as in claim 43, wherein offsetting the first ultrasonic frequency further comprises the step of offsetting the first ultrasonic frequency of the carrier signal from each resonant frequency by 400 Hertz to 2000 Hertz.

* * * * *